US011287197B2

(12) United States Patent
Tonellato

(10) Patent No.: US 11,287,197 B2
(45) Date of Patent: Mar. 29, 2022

(54) HEAT EXCHANGER ASSEMBLY WITH INTEGRATED VALVE AND PRESSURE BYPASS

(71) Applicant: Dana Canada Corporation, Oakville (CA)

(72) Inventor: Silvio E. Tonellato, Hamilton (CA)

(73) Assignee: Dana Canada Corporation, Oakville (CA)

( * ) Notice: Subject to any disclaimer, the term of this patent is extended or adjusted under 35 U.S.C. 154(b) by 174 days.

(21) Appl. No.: 16/839,061

(22) Filed: Apr. 2, 2020

(65) Prior Publication Data

US 2020/0318919 A1 Oct. 8, 2020

Related U.S. Application Data

(60) Provisional application No. 62/830,052, filed on Apr. 5, 2019.

(51) Int. Cl.

| | |
|---|---|
| ***F28F 27/02*** | (2006.01) |
| ***F28D 9/00*** | (2006.01) |
| ***F28F 3/08*** | (2006.01) |
| *F28D 21/00* | (2006.01) |

(52) U.S. Cl.

CPC ..... *F28F 27/02* (2013.01); *F28D 9/0037* (2013.01); *F28F 3/08* (2013.01); *F28D 2021/0049* (2013.01); *F28F 2250/06* (2013.01)

(58) Field of Classification Search

CPC . F01M 5/005; F01M 5/007; F01P 3/12; F01P 7/16; F15B 21/042; F15B 21/045; F16H 57/0413; F28D 9/005; F28D 9/0037; F28D 2021/0049; F28D 2021/0089; F28F 3/086; F28F 3/08; F28F 27/00; F28F 27/02; F28F 2250/06; F28F 2280/06

See application file for complete search history.

(56) References Cited

U.S. PATENT DOCUMENTS

| | | | | | |
|---|---|---|---|---|---|
| 1,690,501 | A * | 11/1928 | Potts | F28F 27/00 | 165/283 |
| 3,401,605 | A * | 9/1968 | Born | G05D 23/1858 | 91/419 |
| 3,921,600 | A * | 11/1975 | Henning | F01P 7/16 | 123/41.54 |
| 5,810,071 | A * | 9/1998 | Pavlin | F01M 5/002 | 165/284 |
| 6,253,837 | B1 * | 7/2001 | Seiler | F28D 1/05375 | 165/103 |

(Continued)

FOREIGN PATENT DOCUMENTS

| | | | | |
|---|---|---|---|---|
| DE | 102006026629 | A1 * | 12/2007 | F28F 27/02 |
| EP | 1772693 | A1 * | 4/2007 | F28D 9/005 |
| WO | 2018154471 | A1 | 8/2018 | |

*Primary Examiner* — Travis Ruby

(74) *Attorney, Agent, or Firm* — Ridout & Maybee LLP

(57) ABSTRACT

An assembly includes a valve integration unit attached to a transmission oil heater. The valve integration unit includes a valve mechanism and a housing having first to sixth fluid ports for oil input and output. The interior space of the housing has a valve chamber to receive a thermal valve mechanism has a temperature responsive actuator. A bypass flow passage is located outside the heat exchanger and is in fluid communication with oil inlet and outlet manifolds through first and second bypass holes provided in the heat exchanger.

15 Claims, 18 Drawing Sheets

(56) References Cited

U.S. PATENT DOCUMENTS 6,401,670 B2 * 6/2002 Frunzetti ..... F01M 5/007 123/41.31
6,920,845 B2 * 7/2005 Lelkes ..... F01P 7/167 123/41.01
7,267,084 B2 * 9/2007 Lutze ..... F01P 3/20 123/41.02
7,721,973 B2 * 5/2010 Peric ..... F16K 3/26 236/93 R
7,735,520 B2 * 6/2010 Peric ..... F28D 9/005 137/855
7,748,442 B2 * 7/2010 Kalbacher ..... F16H 57/0412 165/299
8,066,197 B2 * 11/2011 Sheppard ..... G05D 23/1333 236/93 R
8,181,610 B2 * 5/2012 Dipaola ..... F01P 7/16 123/41.1
8,342,418 B2 * 1/2013 Kanzaka ..... G05D 23/1333 236/99 K
8,919,299 B2 12/2014 Potter
8,960,562 B2 * 2/2015 Neelakantan ..... F16H 57/0413 236/34.5
9,188,055 B2 11/2015 Potter
9,200,713 B2 * 12/2015 Neelakantan ..... F16H 57/0413
9,228,483 B2 * 1/2016 Kuze ..... F01P 7/16
9,945,623 B2 4/2018 Sheppard et al.
10,087,793 B2 * 10/2018 Boyer ..... F16H 57/0412
10,107,158 B2 10/2018 Schmidgall
10,184,735 B2 * 1/2019 Sheppard ..... F28F 27/02
10,222,138 B2 * 3/2019 Ollier ..... F28F 9/00
10,480,871 B2 * 11/2019 Mueller ..... F28D 1/035
10,520,075 B2 * 12/2019 Baaso ..... F16H 57/0413
10,571,204 B2 * 2/2020 Arndt ..... F28F 21/067
10,619,530 B2 * 4/2020 Dries ..... F01P 7/16
10,900,557 B2 * 1/2021 Muhammad ..... F01M 5/005
2002/0023685 A1 * 2/2002 Pas ..... F16K 11/22 137/887
2005/0205236 A1 * 9/2005 Kalbacher ..... F01M 5/002 165/11.1
2006/0032626 A1 * 2/2006 Keen ..... F28D 1/05383 165/280
2006/0108435 A1 * 5/2006 Kozdras ..... F28F 27/02 236/93 R
2006/0237183 A1 * 10/2006 Peric ..... F16K 15/16 165/280
2008/0029246 A1 * 2/2008 Fratantonio ..... G05D 23/1333 165/103
2008/0093066 A1 * 4/2008 Bird ..... F01M 5/005 165/297
2008/0223561 A1 * 9/2008 Li ..... F28F 27/02 165/156
2009/0026405 A1 * 1/2009 Sheppard ..... G05D 23/1333 251/364
2009/0308335 A1 * 12/2009 Dipaola ..... F01P 7/165 123/41.1
2010/0126594 A1 * 5/2010 Sheppard ..... F01P 7/16 137/340
2010/0206516 A1 * 8/2010 Muller-Lufft ..... F28D 9/005 165/96
2010/0213401 A1 * 8/2010 Martin ..... F16H 57/0413 251/321
2012/0055565 A1 * 3/2012 Kanzaka ..... F01M 5/007 137/468
2012/0161042 A1 * 6/2012 Sheppard ..... F16K 11/0716 251/11
2012/0168138 A1 * 7/2012 Myers ..... F02B 29/0475 165/200
2013/0126149 A1 * 5/2013 Kim ..... F28D 9/005 165/297
2013/0133875 A1 * 5/2013 Kim ..... F28D 9/0093 165/296
2013/0152882 A1 6/2013 Potter
2013/0160972 A1 * 6/2013 Sheppard ..... F28F 27/02 165/96
2013/0319634 A1 * 12/2013 Sheppard ..... F28F 27/00 165/96
2013/0327287 A1 * 12/2013 Kim ..... F01P 11/08 123/41.33
2014/0069522 A1 * 3/2014 Kuze ..... F01P 7/14 137/334
2014/0116648 A1 * 5/2014 Cho ..... F28D 9/005 165/96
2016/0215664 A1 * 7/2016 Boyer ..... F01P 7/16
2016/0273854 A1 * 9/2016 Ferlay ..... F02M 35/10052
2016/0290205 A1 * 10/2016 Hebert ..... F01N 5/02
2016/0363399 A1 * 12/2016 Kim ..... F28F 27/02
2017/0175599 A1 * 6/2017 Ariyama ..... F28F 27/02
2017/0324132 A1 * 11/2017 Kenney ..... F28F 3/046
2018/0274406 A1 9/2018 Dries et al.
2018/0371968 A1 * 12/2018 Boyer ..... F28F 27/02
2019/0107345 A1 * 4/2019 Sheppard ..... F28F 27/02
2020/0149623 A1 5/2020 Muhammad et al.
2020/0408135 A1 * 12/2020 Girondi ..... F28F 27/02
2021/0325131 A1 * 10/2021 Tonellato ..... F28D 9/0037

* cited by examiner

HEAT EXCHANGER ASSEMBLY WITH INTEGRATED VALVE AND PRESSURE BYPASS

CROSS-REFERENCE TO RELATED APPLICATION

This application claims priority to and the benefit of United States Provisional Patent Application No. 62/830,052 filed Apr. 5, 2019, the contents of which are incorporated herein by reference.

TECHNICAL FIELD

The invention relates to various heat exchanger assemblies wherein a valve mechanism, such as a control valve or thermal bypass valve, and a pressure bypass, are integrated with a heat exchanger.

BACKGROUND

In the automobile industry, for example, control valves and/or thermal valves are often used in combination with heat exchangers to either direct a fluid to a heat exchanger unit to be cooled/heated, or to direct the fluid elsewhere in the fluid circuit within the automobile system so as to "bypass" the heat exchanger. Control valves or thermal valves are also used within automobile systems to sense the temperature of a particular fluid and direct it to an appropriate heat exchanger, for either warming or cooling, to ensure the fluids circuiting through the automobile systems are within desired temperature ranges.

Traditionally, control valves or thermal bypass valves have been incorporated into a heat exchange system by means of external fluid lines that are connected to an inlet/outlet of a heat exchanger, the control valves being separate to the heat exchanger and being connected either upstream or downstream from the heat exchanger within the external fluid lines. These types of fluid connections require various parts/components which increase the number of individual fluid connections in the overall heat exchange system. This not only adds to the overall costs associated with the system, but also gives rise to multiple potential points of failure and/or leakage. Size constraints are also a factor within the automobile industry with a trend towards more compact units or component structures.

Accordingly, there is a need for improved heat exchanger assemblies that can offer improved connections between the control valves and the associated heat exchanger, and that can also result in more compact, overall assemblies.

SUMMARY OF THE PRESENT DISCLOSURE

In accordance with an aspect of the present disclosure, there is provided a heat exchanger assembly comprising a heat exchanger, a thermal valve integration unit fixedly attached to the heat exchanger, a pressure bypass and a pressure bypass valve assembly.

According to an aspect, the heat exchanger comprises: a plurality of alternating first and second fluid flow passages in heat exchange relation; a first manifold and a second manifold interconnected by the plurality of first fluid flow passages; a third manifold and a fourth manifold interconnected by the plurality of second fluid flow passages.

According to an aspect, the thermal valve integration comprises a housing and a thermal valve mechanism; wherein the housing comprises first to sixth fluid ports, three of the fluid ports being provided for input of a first fluid into the thermal valve integration unit, and three of the fluid ports being provided for output of the first fluid from the thermal valve integration unit.

According to an aspect, the housing further comprises an interior space comprising a first portion and a second portion, the interior space defining a longitudinal axis of the housing, and wherein the second portion of the interior space defines a valve chamber.

According to an aspect, the first and second fluid ports provide fluid communication between the interior space of the housing and the first and second manifolds of the heat exchanger, wherein one of the first and second fluid ports is provided for input of the first fluid from the heat exchanger to the thermal valve integration unit, and the other of the first and second fluid ports is provided for output of the first fluid from the thermal valve integration unit to the heat exchanger.

According to an aspect, the pressure bypass comprises a first bypass hole and a second bypass hole formed in the heat exchanger, and a bypass flow passage, wherein bypass flow passage is in fluid communication with the first manifold through the first bypass hole and in fluid communication with the second manifold through the second bypass hole.

According to an aspect, the pressure bypass valve assembly is adapted to block flow of the first fluid through the bypass flow passage where fluid pressure inside the heat exchanger is less than a threshold pressure, and to permit flow of the first fluid through the bypass flow passage.

According to an aspect, the bypass flow passage is located outside the heat exchanger.

According to an aspect, the heat exchanger comprises first and second end plates at opposite ends of a heat exchanger core comprising a stack of core plates; wherein the thermal valve integration unit is fixedly attached to an outer surface of the first end plate; wherein the first and second bypass holes are provided in the second end plate; and wherein the bypass flow passage is provided on the outer surface of the second end plate.

According to an aspect, the bypass flow passage comprises an elongate channel provided on the outer surface of the second end plate.

According to an aspect, the elongate channel is surrounded by a planar sealing flange which encloses the first and second bypass holes, such that the bypass flow passage comprises a sealed flow passage adapted to carry the first heat transfer fluid between the first and second bypass holes outside the core of the heat exchanger.

According to an aspect, the pressure bypass valve assembly comprises a housing having a first end in sealed fluid communication with a hole in the bypass flow passage which is aligned with the first bypass hole.

According to an aspect, the pressure bypass valve assembly further comprises an annular valve seat located inside the bypass flow passage and surrounding the first bypass hole; and a valve member adapted to form a fluid-tight seal against the valve seat and being slidable in the housing of the pressure bypass valve assembly, toward and away from the valve seat.

According to an aspect, the pressure bypass valve assembly further comprises a spring member which biases the valve member toward the valve seat; wherein the spring member is compressible by the application of a fluid force greater than the threshold pressure to the valve member.

According to an aspect, the third and fourth fluid ports of the thermal valve integration unit provide fluid communication between the interior space of the housing and a first remote vehicle component, wherein one of the third and fourth fluid ports is provided for input of the first fluid from the first remote vehicle component to the thermal valve integration unit, and the other of the third and fourth fluid ports is provided for output of the first fluid from the thermal valve integration unit to the first remote vehicle component.

According to an aspect, the fifth and sixth fluid ports provide fluid communication between the interior space of the housing and a second remote vehicle component, wherein one of the fifth and sixth fluid ports is provided for input of the first fluid from the second remote vehicle component to the thermal valve integration unit, and the other of the fifth and sixth fluid ports is provided for output of the first fluid from the thermal valve integration unit to the second remote vehicle component.

According to an aspect, the first, fourth and sixth fluid ports of the housing are in fluid communication with each other through the first portion of the interior space; and wherein the second, third and fifth fluid ports of the housing are in fluid communication with each other through the second portion of the interior space.

According to an aspect, the thermal valve mechanism is oriented along the longitudinal axis and comprises: a temperature responsive actuator; a first valve element being movable along the longitudinal axis for opening and closing a first valve opening located in the second portion of the interior space, the first valve element and the first valve opening being located between the third fluid port and the fifth fluid port which are longitudinally spaced apart from one another, wherein the movement of the first valve element is actuated by the temperature responsive actuator; and a second valve element being movable along the longitudinal axis for opening and closing a second valve opening located in the second portion of the interior space, the second valve element and the second valve opening being located between the second fluid port and the fifth fluid port which are longitudinally spaced apart from one another, wherein the movement of the second valve element is actuated by the temperature responsive actuator.

According to an aspect, the fifth fluid port is located along the longitudinal axis between the second and third fluid ports.

According to an aspect, the first and second valve members are connected to the temperature responsive actuator.

According to an aspect, the temperature responsive actuator comprises a generally cylindrical actuator body having a first end and a second end, wherein the first valve member is provided at the first end of the actuator and the second valve member is provided at the second end of the actuator.

According to an aspect, the first valve member comprises an annular disc carried on the first end of the temperature responsive actuator.

According to an aspect, the second valve member is slidably received on an outer cylindrical surface of the valve actuator, and is biased toward the second end of the actuator by a first spring member comprising a coil spring which is provided around the outer cylindrical surface of the actuator.

According to an aspect, the heat exchanger is a transmission oil heater; wherein the first fluid is transmission oil; wherein the first remote vehicle component which is in fluid communication with the interior space through the third and fourth fluid ports comprises a transmission oil cooler; and wherein the second remote vehicle component which is in fluid communication with the interior space through the fifth and sixth fluid ports comprises a transmission.

According to an aspect, the housing has a unitary, one-piece construction, and includes a base plate directly connected to the heat exchanger; wherein the base plate has a bottom surface which is sealingly joined to a first end plate of the heat exchanger; and wherein the first and second fluid ports extend through the base plate from the bottom surface to the interior space, to provide fluid communication between the interior space and the first and second manifolds of the heat exchanger.

According to an aspect, the first and second portions of the interior space of the housing are spaced apart along the longitudinal axis and are fluidly isolated from one another.

According to an aspect, there is provided a fluid circulation system in a motor vehicle, comprising the heat exchanger assembly as described herein, wherein the heat exchanger is a transmission oil heat exchanger having coolant inlet and outlet ports, the first fluid is transmission oil and the second fluid is engine coolant.

According to an aspect, the fluid circulation system further comprises an internal combustion engine having coolant inlet and outlet ports; a transmission; a transmission oil cooler; a pair of transmission oil conduits connecting the third and fourth fluid ports of the valve integration unit to the transmission oil cooler; a pair of transmission oil conduits connecting the fifth and sixth fluid ports of the valve integration unit to the transmission; and a pair of coolant conduits connecting the coolant inlet and outlet ports of the internal combustion engine to the coolant inlet and outlet ports of the transmission oil heat exchanger.

According to an aspect of the fluid circulation system, the transmission oil heat exchanger is a transmission oil heater or a second transmission oil cooler.

BRIEF DESCRIPTION OF THE DRAWINGS

Exemplary embodiments of the present disclosure will now be described, by way of example, with reference to the accompanying drawings, in which.

DETAILED DESCRIPTION OF EXEMPLARY EMBODIMENTS

Figure 1:
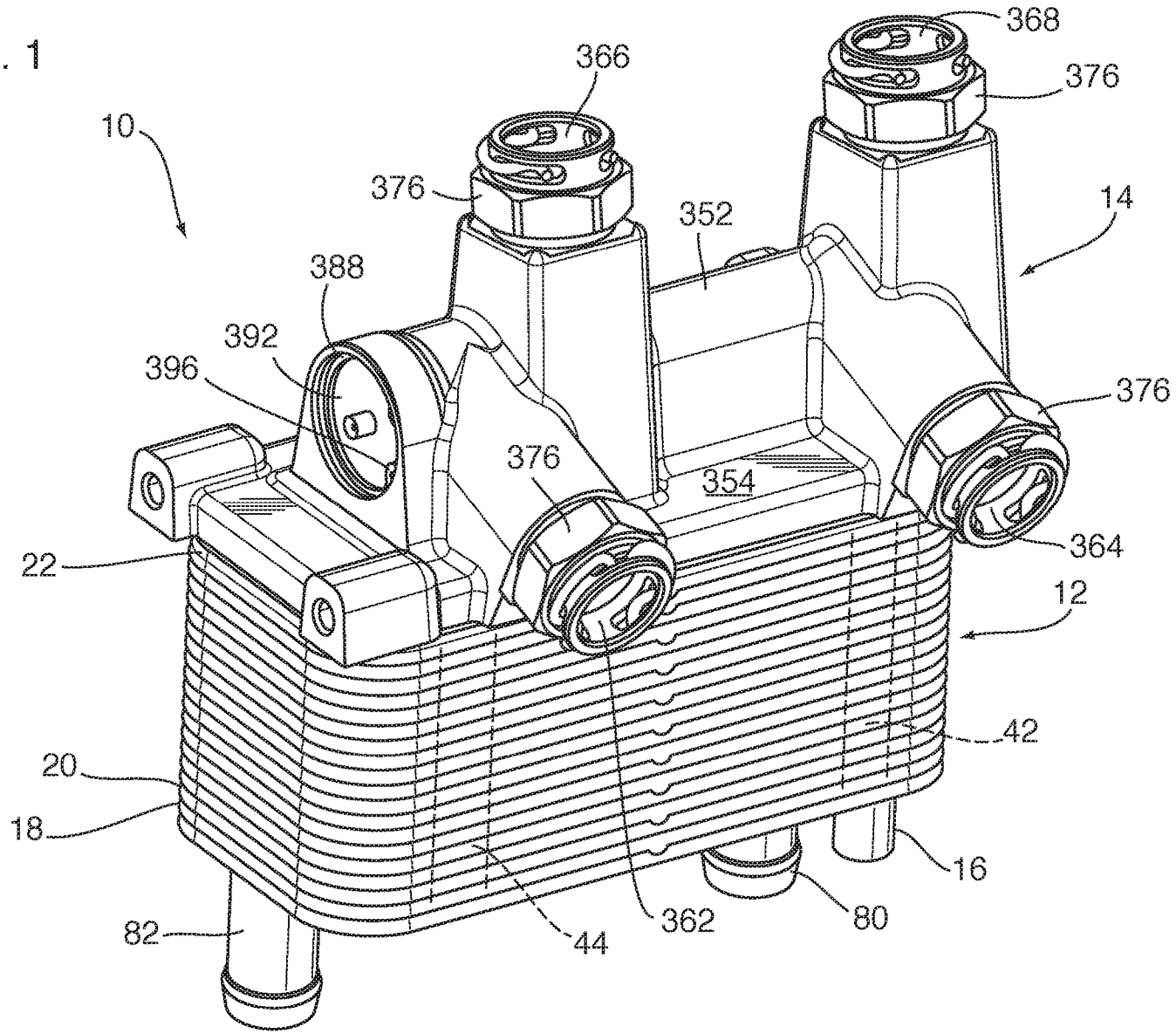
FIG. 1 is a perspective top view of a heat exchanger assembly with an integrated valve structure and a pressure relief feature, according to an example embodiment of the present disclosure.
Figure 2:
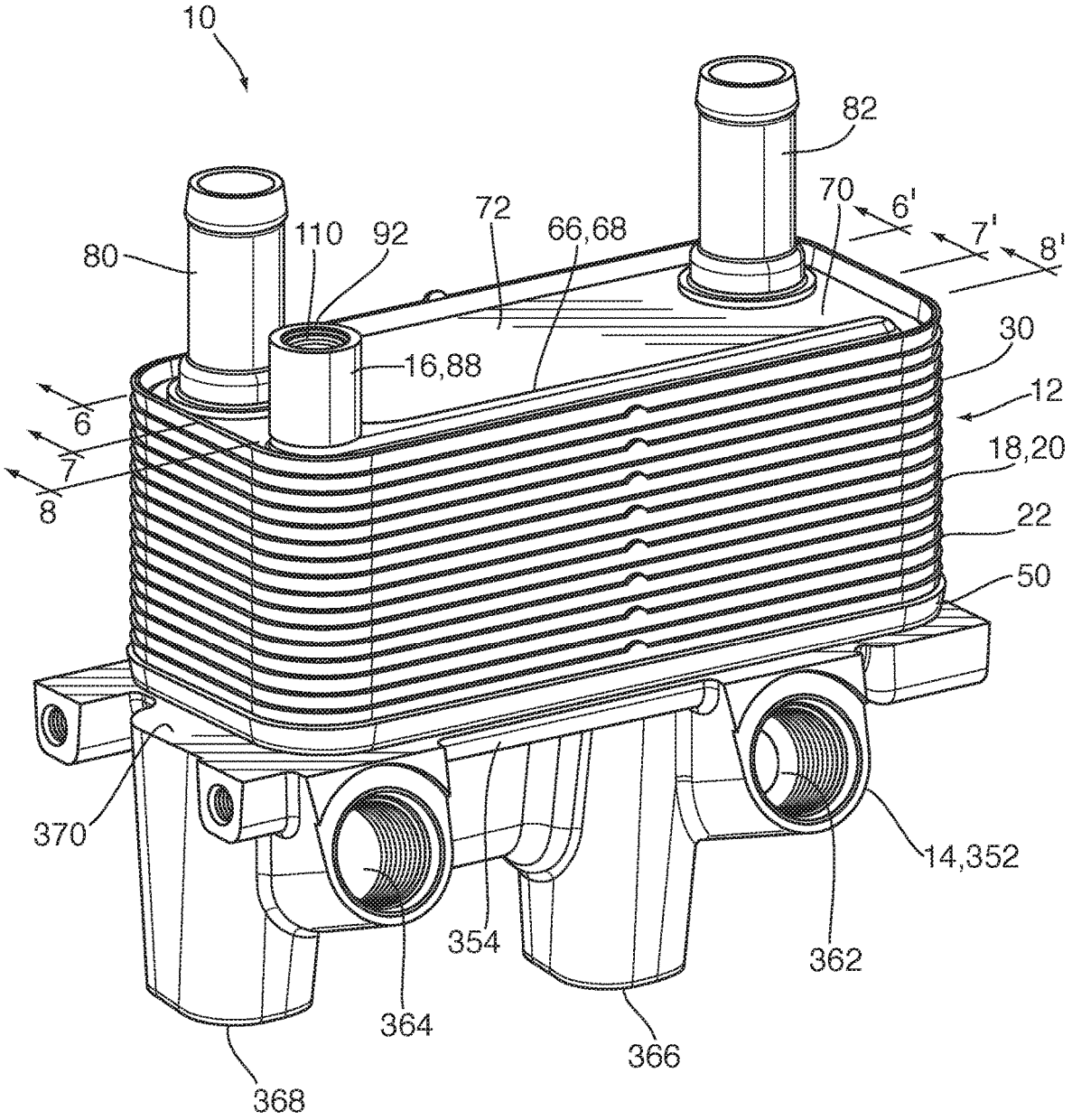
FIG. 2 is a bottom perspective view of the heat exchanger assembly of FIG. 1.
Figure 3:
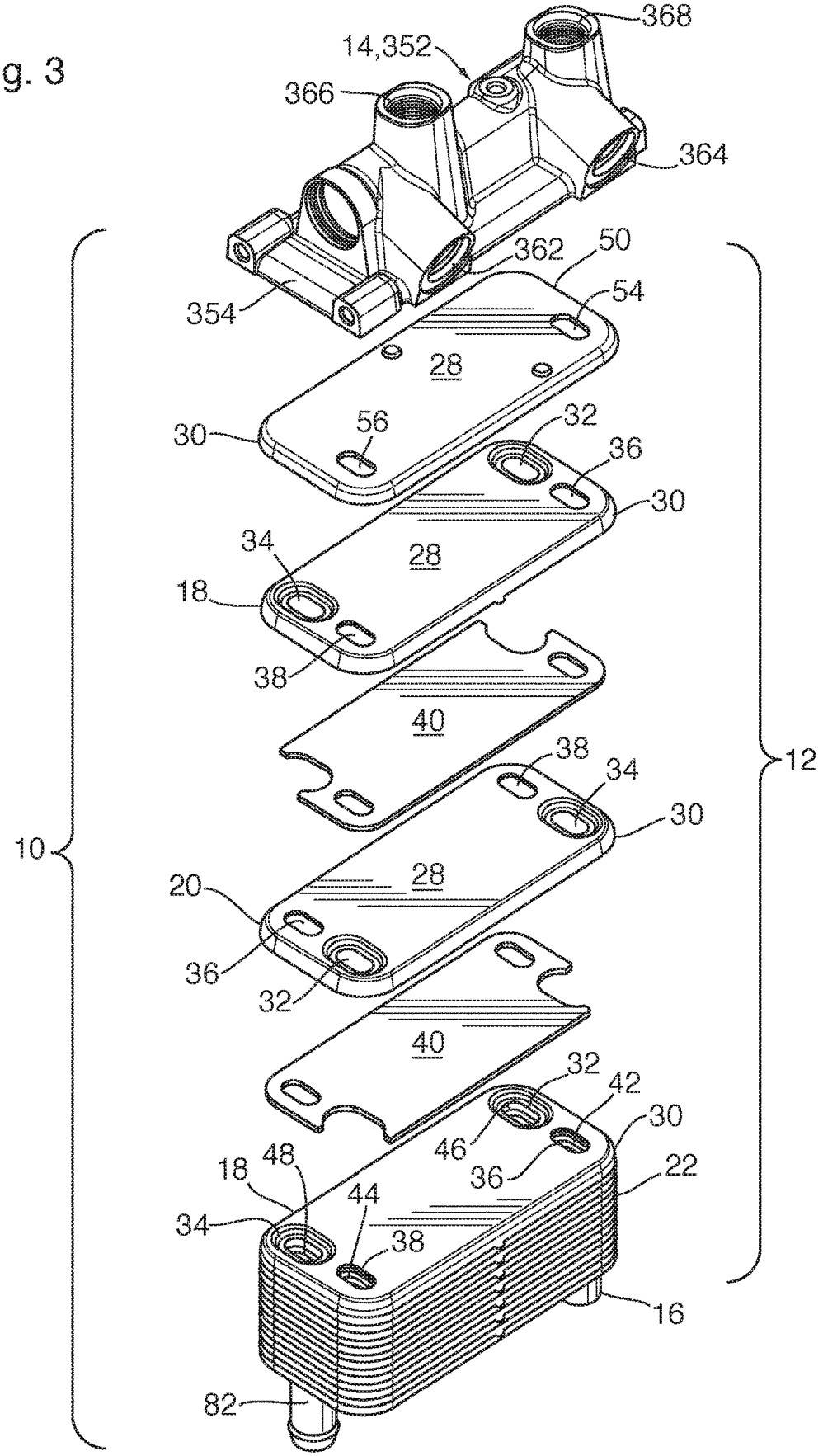
FIG. 3 is a perspective view of the heat exchanger assembly of FIG. 1, showing the top portion of the heat exchanger assembly in a partially disassembled state.

A heat exchanger assembly 10 according to an example embodiment will now be described with specific reference to the FIGS. 1-16.

Heat exchanger assembly 10 comprises a heat exchanger 12, a thermal valve integration unit 14 and a pressure bypass valve assembly 16.

Heat exchanger 12 is comprised of a plurality of stamped heat exchanger core plates 18, 20 disposed in alternating, stacked, brazed relation to one another to form a heat exchanger core 22, with alternating first and second fluid flow passages 24, 26 formed between the stacked core plates 18, 20. The first fluid flow passages 24 are for flow of a first heat transfer fluid, and the second fluid flow passages 26 are for flow of a second heat transfer fluid. In the present embodiment, the first heat transfer fluid (also referred to herein as the "first fluid" or "oil") is a transmission oil, and the second heat transfer fluid (also referred to herein as the "first fluid" or "coolant") is engine coolant, which typically comprises glycol or a glycol/water mixture. In other embodiments, the first heat transfer fluid may be engine oil. It will be appreciated that the coolant may either absorb heat from the oil or transfer heat to the oil, depending on the temperature differential between the oil and coolant, which depends on the operating state of the motor vehicle.

The core plates 18, 20 may be identical to one another, with the alternating arrangement of core plates 18, 20 being provided by rotating every other core plate 18, 20 in the stack by 180 degrees (i.e. end-to-end), relative the adjacent core plates 18, 20 in the stack.

The core plates 18, 20 each comprise a generally planar base portion 28 surrounded on all sides by sloping edge walls 30. The core plates 18, 20 are stacked one on top of another with their edge walls 30 in nested, sealed engagement. Each core plate 18, 20 is provided with four holes 32, 34, 36, 38 near its four corners, each of which serves as an inlet hole or an outlet hole for the first or second heat transfer fluid as required by the particular application. Two holes 32, 34 are raised with respect to the base portion 28 of the core plate 18, 20, and are formed in a raised boss which has a flat sealing surface surrounding the holes 32, 34. The other two holes 36, 38 are co-planar or flush with the base portion 28 of the plate 18, 20. The two raised holes 32, 34 are arranged at opposite ends of core plate 18, 20, and the two flush holes 36, 38 are similarly arranged at opposite ends of the core plate 18, 20.

The raised holes 32, 34 in one core plate 18 or 20 align with the flat or co-planar openings of an adjacent core plate 18 or 20, with the flat sealing surface surrounding the raised holes 32, 34 sealing against the area of base portion 28 surrounding the flush holes 36, 38 of the adjacent core plate 18 or 20. This engagement between the core plates 18, 20 spaces apart the base portions 28 of adjacent core plates 18, 20, thereby defining the alternating first and second fluid flow passages 24, 26. Each fluid flow passage 24 or 26 will have inlet and outlet openings defined by the flush holes 36, 38, which are aligned with the raised holes 32, 34 of an adjacent core plate 18, 20.

Each fluid flow passages 24, 26 may be provided with a turbulizer sheet 40, to improve heat transfer, as is known in the art. Each turbulizer sheet 40 includes cut-outs for the holes 32, 34, 36, 38. The height of each turbulizer sheet 40 is about the same as the height of the fluid flow passage 24, 26 in which it is located, such that the top and bottom surfaces of the turbulizer sheet 40 are in thermal contact with the core plates 18, 20 between which the fluid flow passage 24, 26 is defined. To enhance clarity of the cross-sectional views of FIGS. 6-9, the turbulizer sheets 40 are not shown in these drawings. Alternatively, rather than having turbulizer sheets 40 positioned in each of the fluid flow passages 24, 26, the core plates 18, 20 may themselves may be formed with heat transfer augmentation features, such as ribs and/or dimples formed in the planar base portion 28 of the core plates 18, 20, as is known in the art.

The holes 32, 34, 36, 38 in the core plates 18, 20 are aligned to form a first manifold 42 and a second manifold 44 coupled together by the first fluid flow passages 24, and a third manifold 46 and fourth manifold 48 coupled together by the second fluid flow passages 26. Either the first or second manifold 42, 44 may be the oil inlet manifold or the oil outlet manifold, and either the third or fourth manifold 46, 48 may be the coolant inlet manifold or the coolant outlet manifold, depending on the desired direction of flow through the heat exchanger 12. Also, the flow direction of the first heat transfer fluid in the first fluid flow passages 24 may be the same ("co-flow") or opposite ("counter-flow") to the flow direction of the second heat transfer fluid in the second fluid flow passages 26.

Top and bottom plates 50, 52 (also referred to herein as "end plates") enclose the core 22 of heat exchanger 12. Subject to the discussion of the pressure bypass valve assembly below, the top and bottom plates 50, 52 together close one end of each manifold 42, 44, 46, 48 and provide a conduit opening at the other end of the manifold 42, 44, 46, 48. The locations of the conduit openings in end plates 50, 52 will depend upon the requirements of each particular application, such that each end plate 50, 52 will have from zero to four conduit openings, with the total number of conduit openings being four, i.e. one for each manifold 42, 44, 46, 48.

In the present embodiment, top plate 50 has two conduit openings 54, 56, which define inlet and outlet openings for the first heat transfer fluid (oil), while the bottom plate 52 has two conduit openings 58, 60, which define inlet and outlet openings for the second heat transfer fluid (coolant). The terms "top" and "bottom" are used herein for convenience only, and are consistent with the orientations of the heat exchanger assembly 10 shown in FIGS. 1 and 2. However, it should not be implied from the use of these terms that the heat exchanger assembly 10 is required to have any specific orientation when in use.

Figure 5:
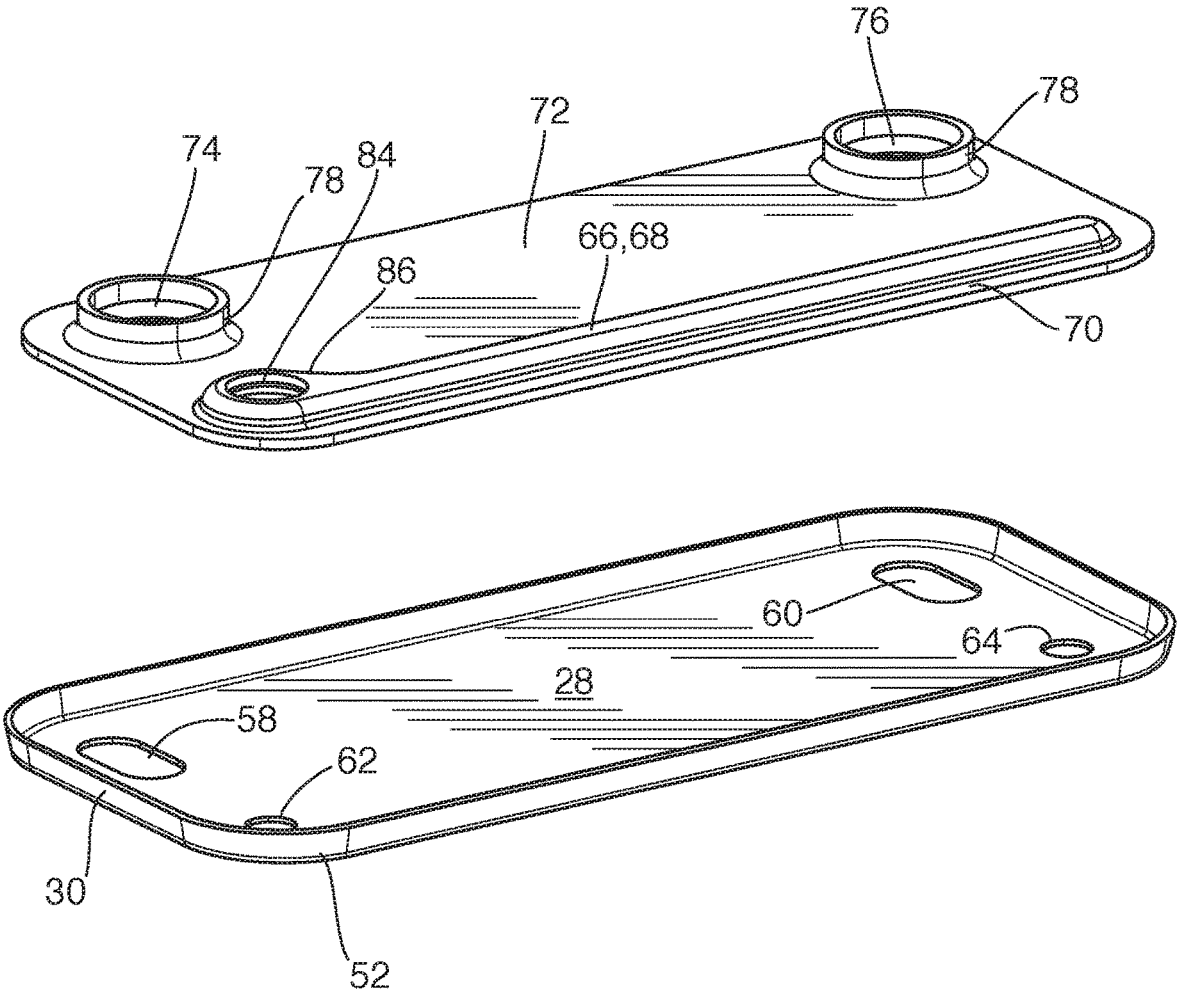
FIG. 5 is a perspective view of the bottom plate and sealing flange plate of the heat exchanger assembly of FIG. 1.

As shown in FIG. 5, the top plate 50 generally has the same shape as core plates 18, 20, having a generally planar base portion 28 and a sloping edge wall 30, and with its two conduit openings 54, 56 being flush with the planar base portion 28 and aligned with the two flush holes 36, 38 of the immediately adjacent core plate 18 or 20. As can be seen from FIGS. 6-8, the top plate 50 may be somewhat thicker than core plates 18, 20 to enhance rigidity of the heat exchanger 12. Also, planar base portion 28 of top plate 50 may be slightly larger than the planar base portions 28 of core plates 18, 20, such that the immediately adjacent core plate 18 or 20 nests within the top plate 50 with its planar base portion 28 sealingly engaging the planar base portion 28 of top plate 50. Thus, the top plate 50 is configured to permit the first heat transfer fluid (oil) to enter and exit the first and second manifolds 42, 44 of heat exchanger 12 through its two conduit openings 54, 56 at the top of the heat exchanger 12, while the planar base portion 28 of top plate 50 seals the top ends of the third and fourth manifolds 46, 48.

As will be further discussed below, the top (outer) surface of top plate 50 provides a surface on which the thermal valve integration unit 14 is mounted. In some embodiments, the top surface of top plate 50 may be provided with fittings which are inserted into a pair of oil ports of the thermal valve integration unit 14, however, in the present embodiment, the top plate 50 is not provided with such fittings.

Figure 4:
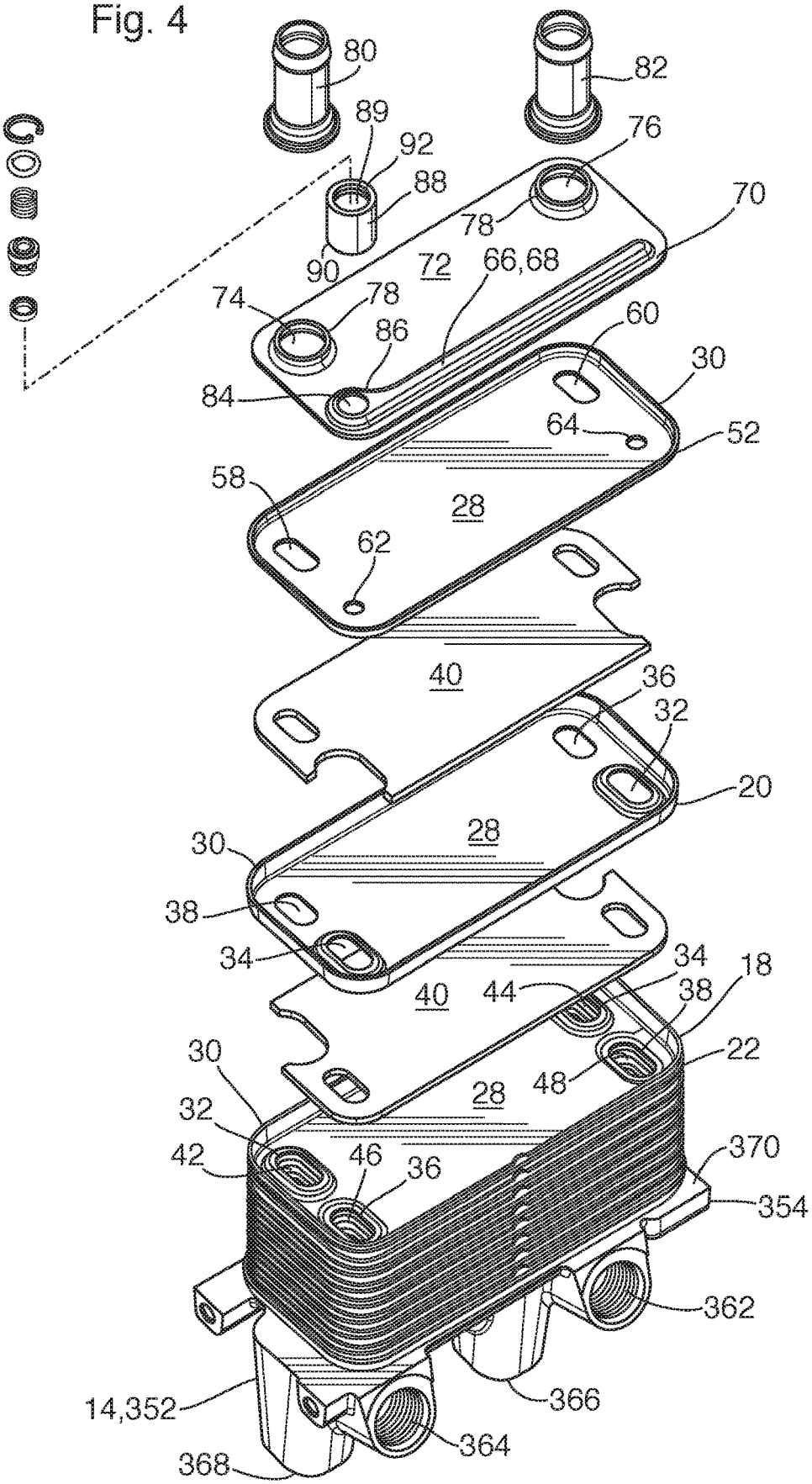
FIG. 4 is a perspective view of the heat exchanger assembly of FIG. 1, showing the bottom portion of the heat exchanger assembly in a partially disassembled state.

The bottom plate 52 has generally the same shape as core plates 18, 20, having a generally planar base portion 28 and a sloping edge wall 30, and with two conduit openings 58, 60 being flush with the planar base portion 28. When the sloping edge wall 30 of bottom plate 52 is nested with the sloping edge wall 30 of the immediately adjacent core plate 18 or 20, the conduit openings are in aligned spaced relation with the two flush holes 36, 38 of the immediately adjacent core plate 18 or 20, and the planar base portion 28 of the bottom plate 52 is sealingly engaged to the sealing surfaces surrounding the raised holes 32, 34 of immediately adjacent core plate 18 or 20. This creates a space between the planar base portion 28 of the bottom plate 52 and the immediately adjacent core plate 18 or 20. This space defines a second fluid flow passage 26, and may be provided with a turbulizer sheet 40, as shown in FIG. 4. Thus, the bottom plate 52 is configured to permit the second heat transfer fluid (coolant) to enter and exit the third and fourth manifolds 46, 48 of heat exchanger 12 through two conduit openings 58, 60 at the bottom of the heat exchanger 12.

In the present embodiment, the planar base portion 28 of bottom plate 52 does not completely block or seal the bottom ends of the first and second manifolds 42, 44. Rather, the planar base portion 28 of bottom plate 52 includes a pair of flush bypass holes 62, 64 which are aligned with the raised holes 32, 34 of the immediately adjacent core plate 18 or 20, so as to provide fluid communication with the first and second manifolds 42, 44. The bypass holes 62, 64 may optionally be smaller than the raised holes 32, 34 of adjacent core plate 18, 20, but not necessarily so.

The heat exchanger assembly 10 further comprises a bypass flow passage 66 which provides fluid communication between the bypass holes 62, 64, external to the heat exchanger core 22. In this regard, the bypass flow passage 66 comprises an elongate channel or rib 68. The elongate channel 68 is surrounded by a planar sealing flange 70 which surrounds and encloses the two bypass holes 62, 64, so as to form a sealed flow passage to carry the first heat transfer fluid (oil) between the two bypass holes 62, 64 outside the core 22.

In the present embodiment, the planar sealing flange 70 is in the form of a plate structure having a planar base portion 72 which is sized and shaped to fit within the sloping edge walls 30 of the bottom plate 52, and to lie flat against and seal to the planar base portion 28 of bottom plate 52. The elongate channel 68 is in the form of an embossment provided in the planar base portion 72 of sealing flange 70.

Because the planar base portion 72 of sealing flange 70 has substantially the same size and shape as the planar base portion 28 of bottom plate 52, the planar base portion 72 of sealing flange 70 is also provided with a pair of conduit openings 74, 76 which are aligned with the conduit openings 58, 60 of the bottom plate 52, so as to provide fluid communication with the third and fourth manifolds 46, 48. As shown, the conduit openings 74, 76 may each be surrounded by an upstanding, annular sealing collar 78. The sealing collars 78 are adapted to fit within and form sealed connections with the base portions of tubular fittings 80, 82, through which the second fluid (coolant) enters and leaves the heat exchanger 12. The tubular fittings 80, 82 are configured for connection to hoses or tubes (not shown) in the vehicle's coolant circulation system. It will be appreciated that the provision of sealing collars 78 on sealing flange 70 is not essential in all embodiments. For example, the conduit openings 74, 76 may be simple flush holes, and the fittings 80, 82 may each be provided with flat sealing flanges to seal against the outer surface of the sealing flange 70. Also, in some embodiments, the sealing flange 70 may not be extended over the conduit openings 58, 60 of bottom plate 52, in which case the fittings 80, 82 will be sealingly joined directly to the outer surface of the bottom plate 52.

Figure 6:
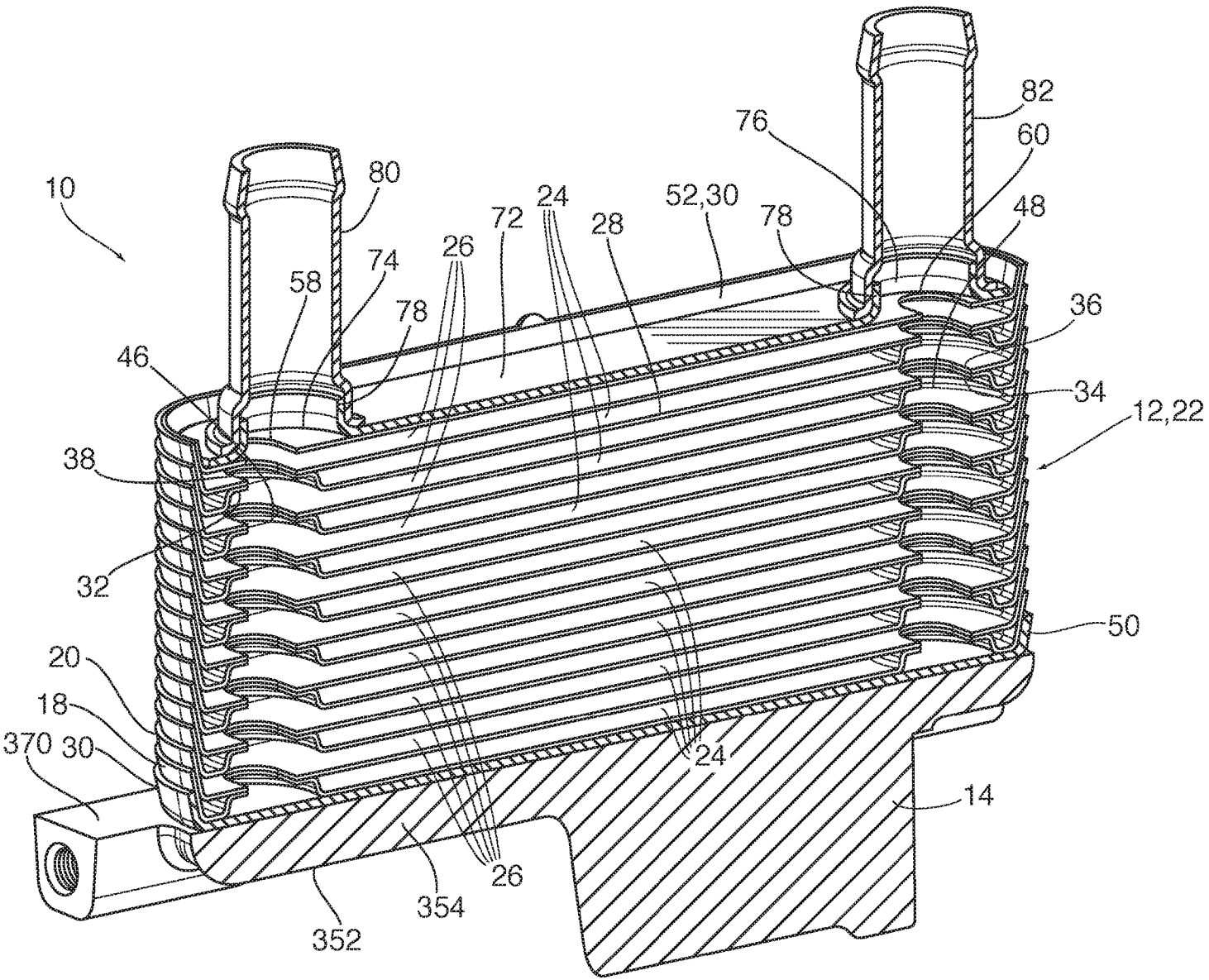
FIG. 6 is a longitudinal cross-section along line 6-6' of FIG. 2, through the coolant manifolds of the heat exchanger.
Figure 7:
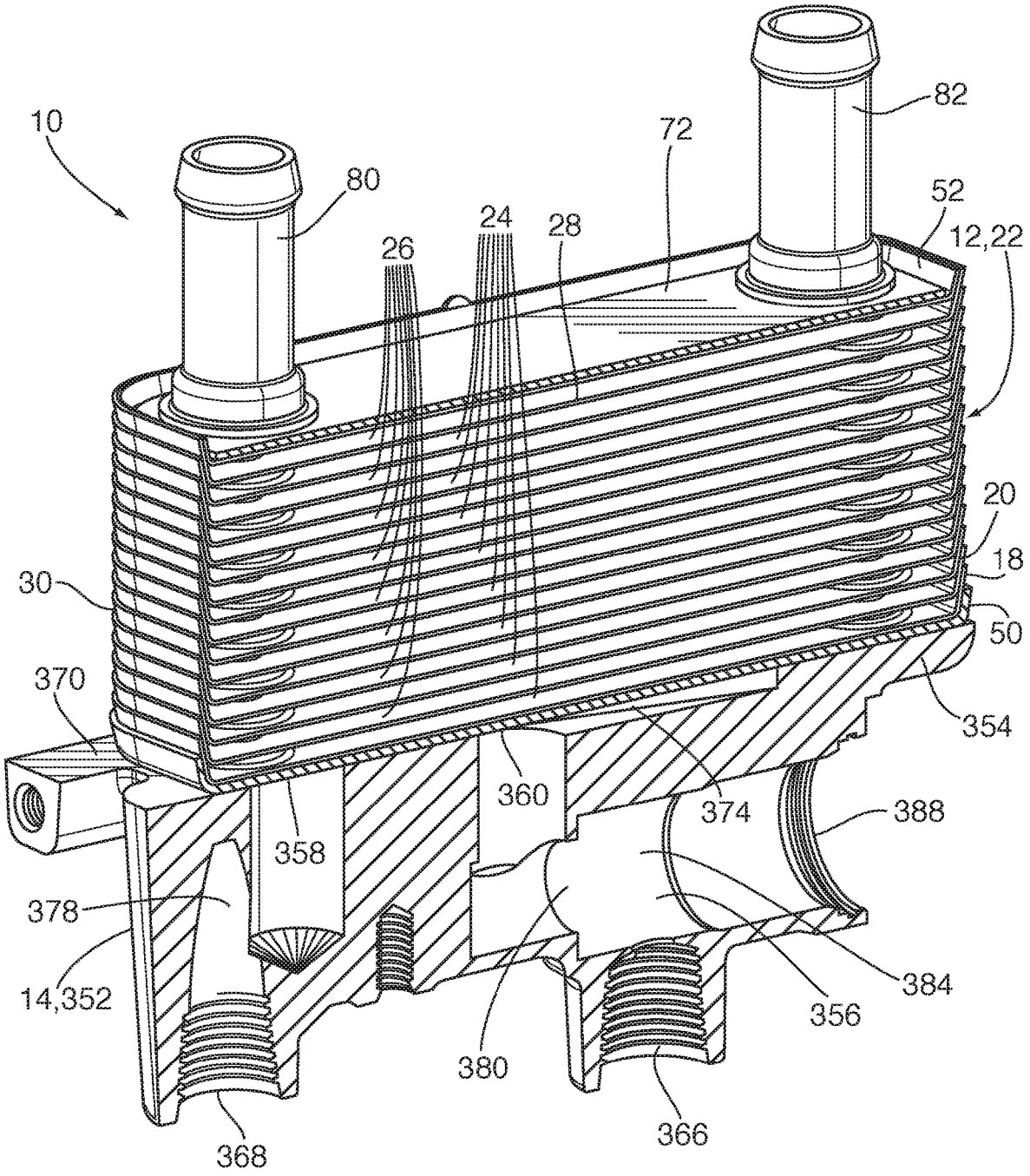
FIG. 7 is a longitudinal cross-section along line 7-7' of FIG. 2, through the valve chamber of the valve integration unit.
Figure 8:
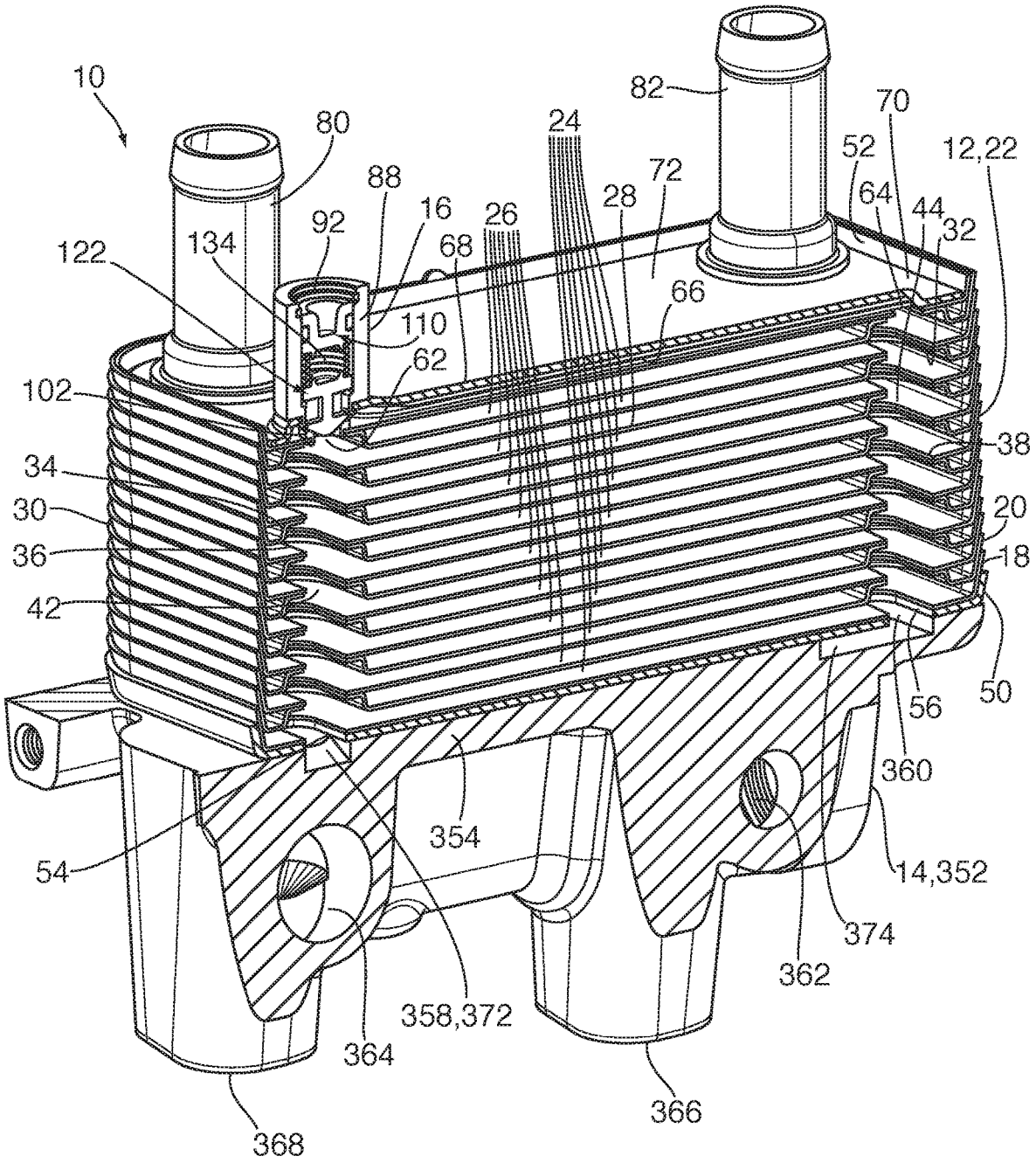
FIG. 8 is a longitudinal cross-section along line 8-8' of FIG. 2, through the oil manifolds and the pressure bypass valve.

As can be seen from FIGS. 6-8, the bottom plate 52 has a similar thickness as core plates 18, 20, and the sealing flange plate 70 may be somewhat thicker. Therefore, the combined thicknesses of the planar base portions 28, 72 of bottom plate 52 and sealing flange plate 70 may be greater than the thicknesses of the core plates 18, 20.

As shown in the drawings, the elongate channel 68 is provided with a hole 84 surrounded by a flat, annular surface 86, wherein the hole 84 and sealing surface 86 are adapted to receive and seal with the housing 88 of the pressure bypass valve assembly 16. In the present embodiment, the width of the elongate channel 68 is enlarged in the vicinity of bypass hole 62 in order to accommodate the hole 84 and the surrounding annular surface 86.

The housing 88 of valve assembly 16 is generally cylindrical, having a hollow bore 89 and first and second open ends 90, 92. As shown, the first open end 90 may be formed with a flat annular surface 94 to seat against the annular surface 86 of elongate channel 68, and with an annular projection 96 adapted to fit within the hole 84. The annular projection 96 may be provided with an annular groove 98 and with a detent 100, so as to receive and provide an interference fit with the edge of the hole 84, thereby sealing and maintaining the position of housing 88 relative to the hole 84. The hollow bore 89 may be reduced in diameter by an inwardly extending projection or shoulder 101 provided at the first open end 90 of housing 88, for reasons which will be discussed below.

The pressure bypass valve assembly 16 further comprises an annular valve seat 102 which is located inside the bypass flow passage 66, and surrounds the bypass hole 64 of bottom plate 52. As with the housing 88, the annular valve seat 102 may be provided with an annular projection 104 adapted to fit within the bypass hole 64. The annular projection 104 may be provided with an annular groove 106 and with a detent 108, so as to receive and provide an interference fit with the edge of the bypass hole 64, thereby sealing and maintaining the position of valve seat 102 relative to the hole 64. The inner edge of the valve seat 102 may be provided with a chamfer 103 for purposes which will be further discussed below.

The housing 88 and/or the annular valve seat 102 may be formed from metal or from a resilient material such as plastic. Where the housing 88 and/or annular valve seat 102 are comprised of plastic, they will be secured to the inner edges of respective holes 84 and 64 after the metal components of the heat exchanger assembly 10 are assembled by brazing. In this type of construction, the hole 84 in elongate channel 68 is of sufficiently large diameter to allow the annular valve seat 102 to be passed through the hole 84 during assembly.

The second open end 92 of the valve housing 88 is sealed by a generally cylindrical valve cap 110, which is adapted to fit within the bore 89 of housing 88. The valve cap 110 has an annular groove 112 which receives a resilient sealing member such as O-ring 114, wherein the O-ring 114 forms a fluid-tight seal with the inner surface of bore 89. The valve cap 110 is retained by a flat, annular, resilient C-ring 116 having an outer edge which is received in an annular groove 118 formed in the bore 89, at the second end 92 of housing 88, wherein the inner edge of the C-ring 116 projects inwardly from the inner bore 89 to engage an outer end face 120 of the valve cap 110. The valve cap 110 also includes an inner end face 121 which is discussed below.

The pressure bypass valve assembly 16 further comprises a valve member 122 having a first end portion 124 adapted to form a fluid-tight seal against the valve seat 102. In the present embodiment, the valve member 124 is generally cylindrical, and the first end portion 124 has a sloped, conical first end face 126 adapted to seal against the chamfered inner edge 103 of the valve seat 102.

Figure 9:
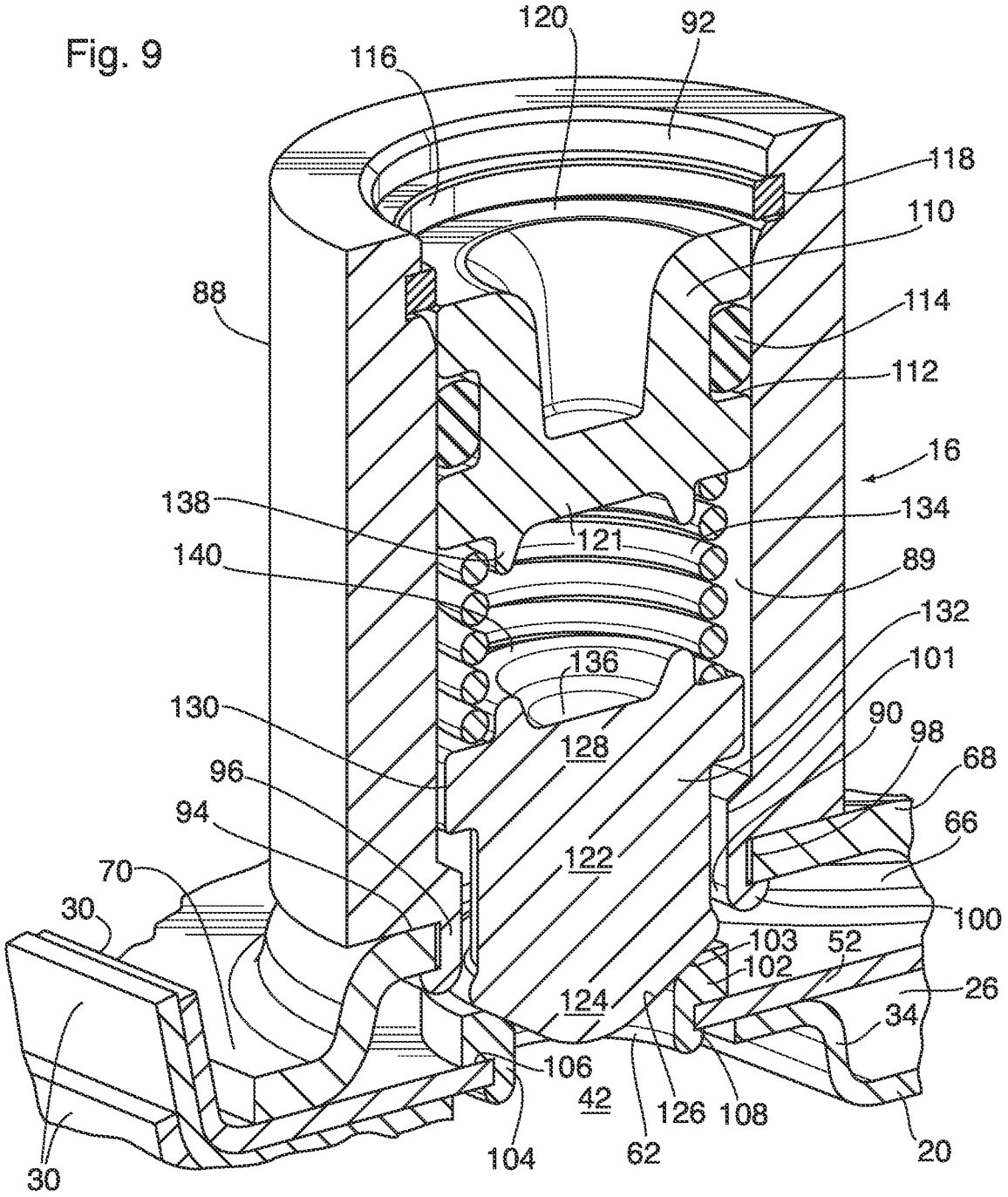
FIG. 9 is a partial close-up of the cross-section of FIG. 8, showing the pressure bypass valve and its immediate surroundings.
Figure 10:
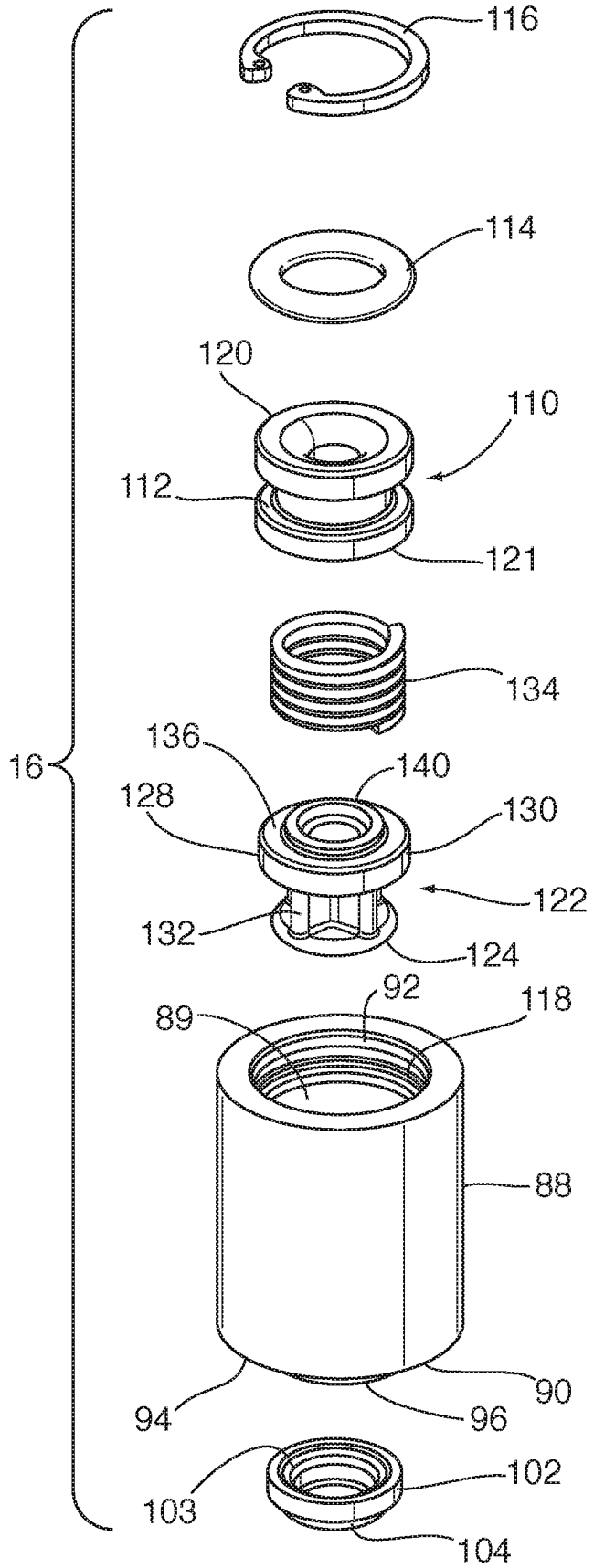
FIG. 10 is an exploded view of the components making up the pressure bypass valve.
Figure 11:
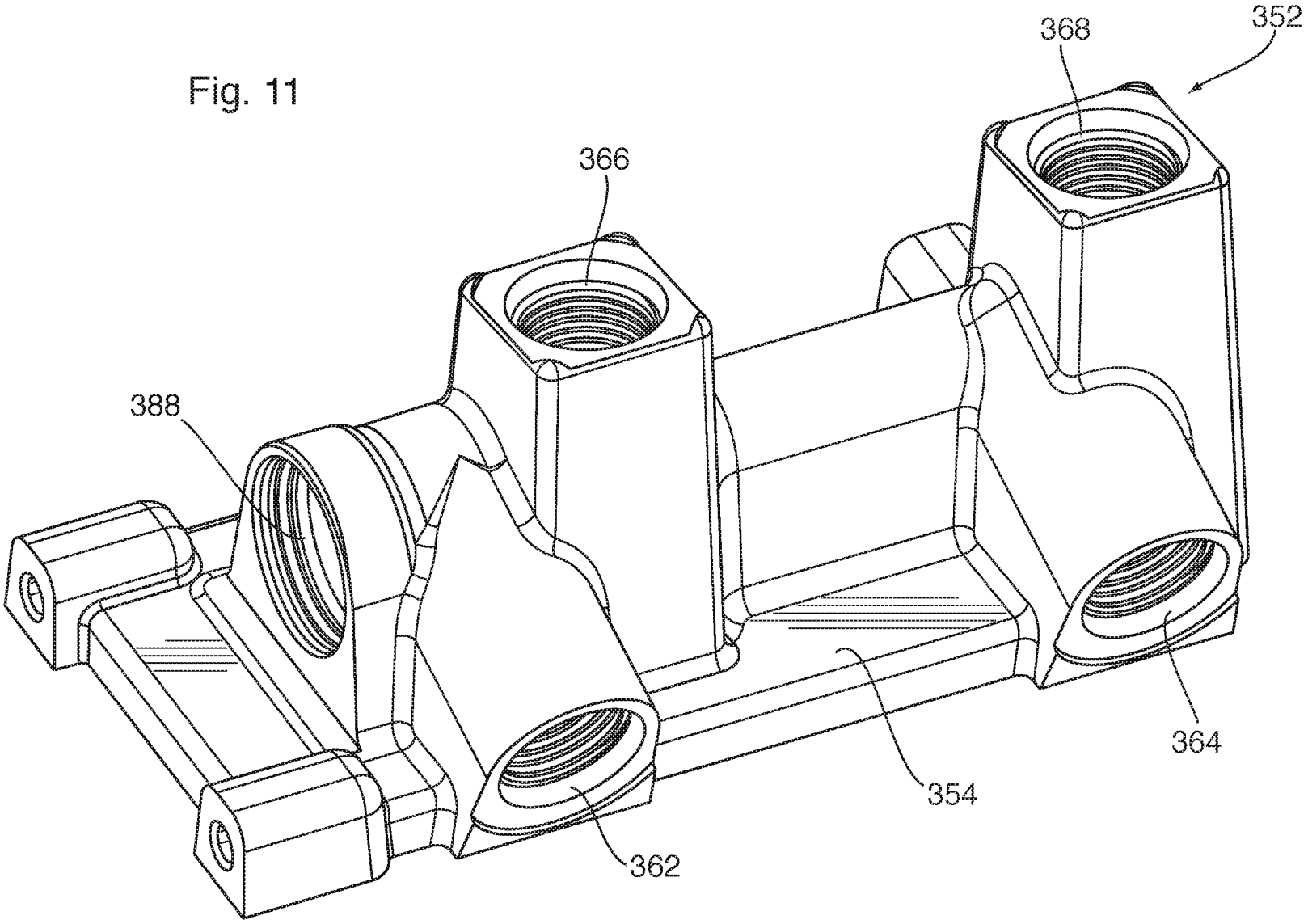
FIG. 11 is a top perspective view of the housing of the thermal valve integration unit.

The valve member 122 has a second end portion 128 in the form of a cylinder having an outer cylindrical face 130 which is adapted to slide along the inner surface of bore 89. The second end portion 128 may have a larger diameter than the inwardly projecting shoulder 101 at the first end 90 of housing 88, to retain the valve member 122 inside bore 89. As shown in FIG. 9, the first and second end portions 124, 128 may be joined together by one or more webs 132, and the entire structure of valve member 124 may be machined or molded from metal or plastic.

The pressure bypass valve assembly 16 further comprises a coil spring 134 which is received under compression between the inner face 121 of valve cap 110 and a second end face 136 of the valve member 122, which may be provided with respective annular projections 138, 140 which fit within the opposite ends of spring 134 to retain it in position. Because the spring 134 is under compression, it will force the valve member 122 into engagement with the valve seat 102 under normal pressure conditions.

It can be seen that the existence of a sufficiently high first fluid (oil) pressure inside the first manifold 42 (which will be considered the oil inlet manifold in the present embodiment) will counteract the force of the spring 134, and will force the first end face 126 of valve member 122 out of engagement with the valve seat 102, thereby permitting the first fluid to enter the bypass flow passage 66 and flow toward the bypass hole 64 at the opposite end of passage 66. The first fluid then enters the second manifold 44 (considered the oil outlet manifold in the present embodiment), thereby bypassing the first fluid flow passages 24. Once the pressure of the first fluid returns to a normal level, the spring 134 will overcome the force exerted by the first fluid and once again bring the valve member 122 into engagement with the valve seat 102, to close the bypass flow passage 66.

The valve integration unit 14 is now described below.

Figure 12:
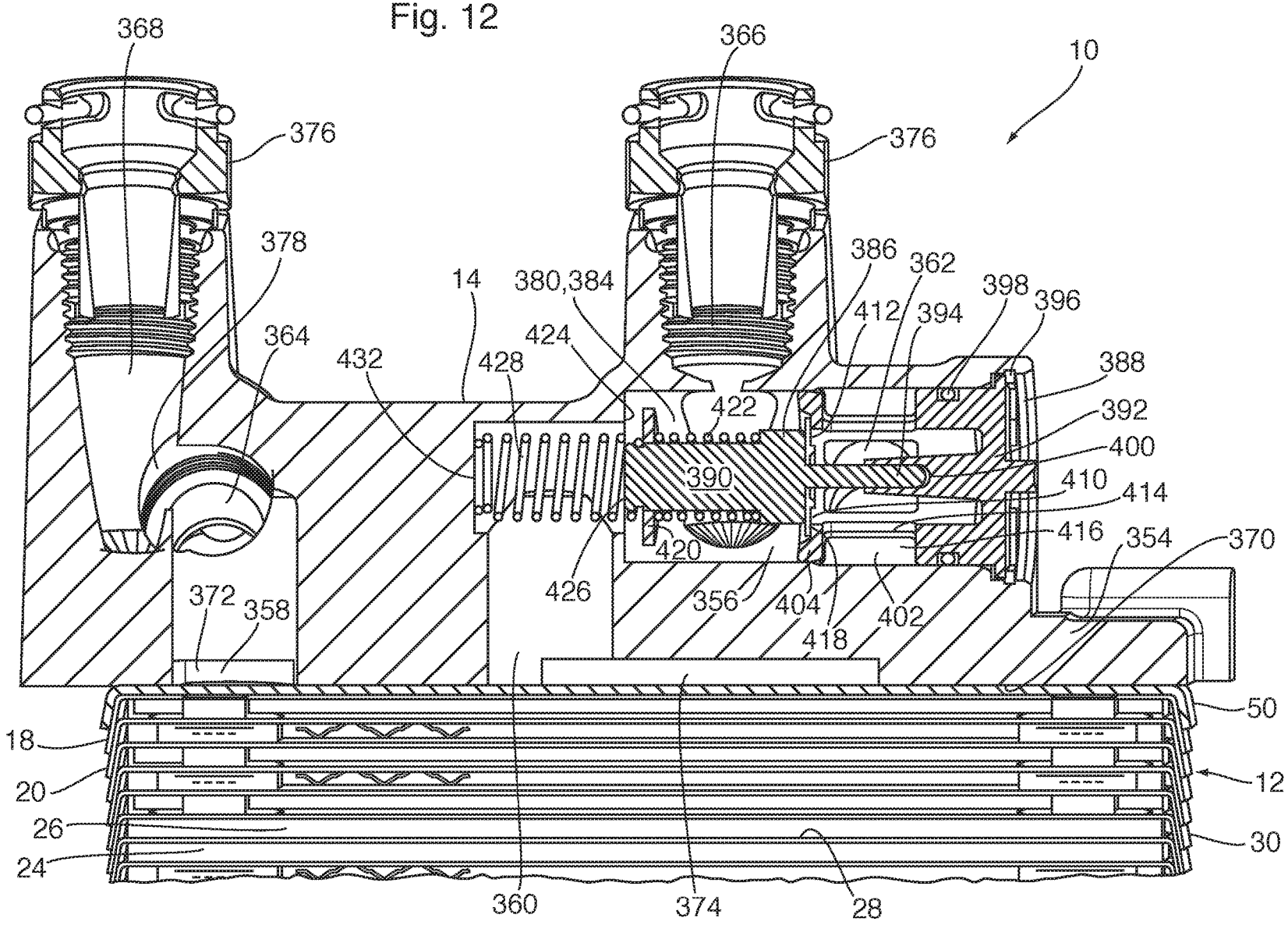
FIG. 12 is a longitudinal cross-section through the heat exchanger assembly of FIG. 1, showing the thermal valve in a cold state.
Figure 13:
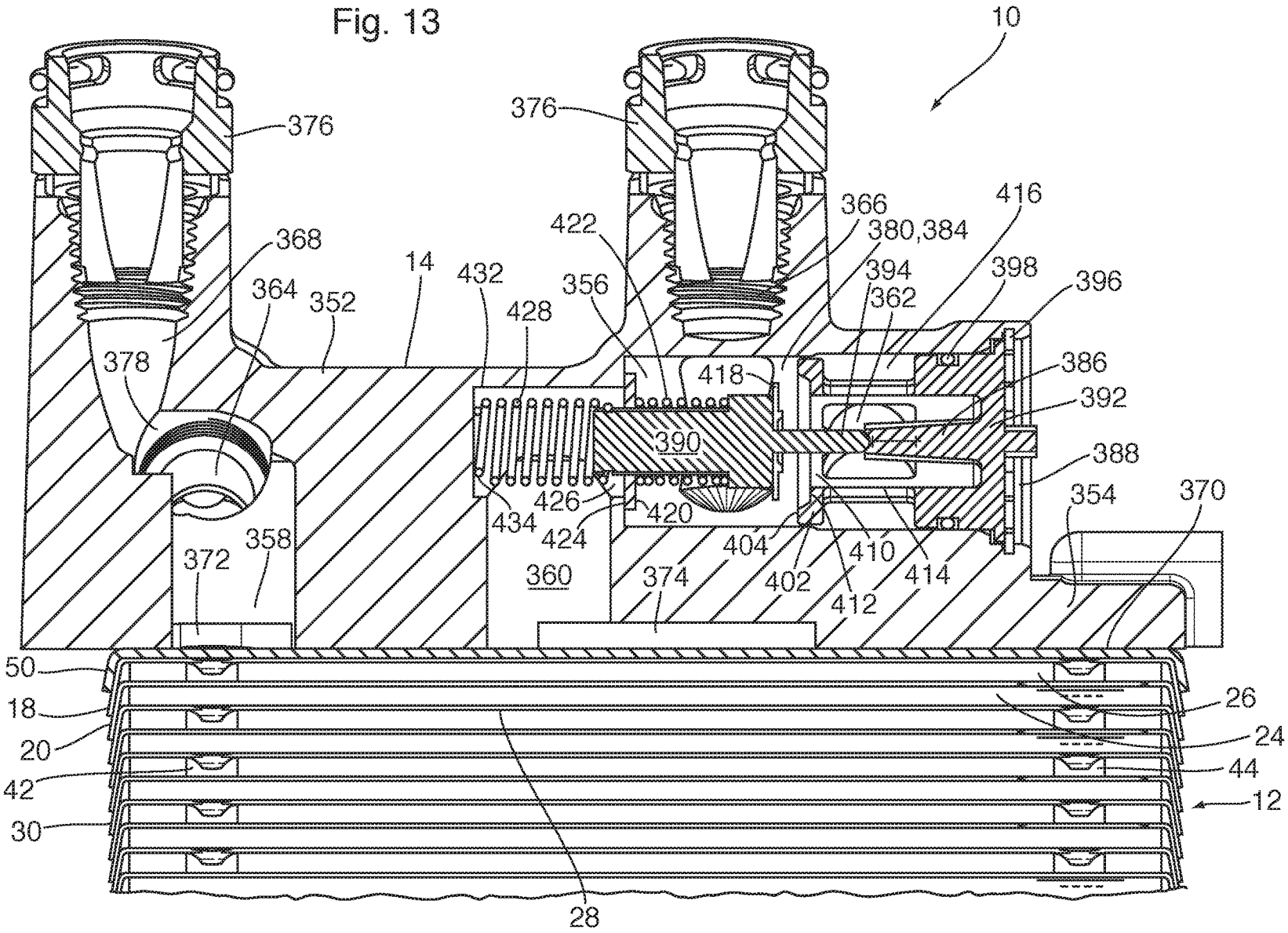
FIG. 13 is a longitudinal cross-section through the heat exchanger assembly of FIG. 1, showing the thermal valve in a hot state.

Valve integration unit 14 comprises a housing 352 which is shown in a number of the drawings. In this regard, the housing 352 is shown without the thermal valve or fittings in FIGS. 2-4, 6-8, 11, 14 and 15; while FIGS. 1, 12 and 13 show the assembled thermal valve integration unit 14, including the housing 352, the thermal valve and the fittings.

The housing 352 includes a base plate 354, an interior space 356, and six oil ports 358, 360, 362, 364, 366 and 368, all of which are in fluid communication with the interior space 356. The housing 352 may have a unitary, one-piece construction, and may be formed by casting, extrusion, forging and/or machining.

The base plate 354 has a bottom surface 370 that is adapted to be sealingly joined to the top plate 50 of heat exchanger 12, for example by brazing. The first and second oil ports 358, 360 extend through the base plate 354 from the bottom surface 370 to the interior space 356, to provide fluid communication between the interior space 356 and the respective first and second manifolds 42, 44 of heat exchanger 12. Depending on the required arrangement of oil ports in the housing 352, the first oil port 358 and/or the second oil port 360 may not be in direct alignment with respective conduit openings 54, 56 in the top plate 50, or with the first and second manifolds 42, 44 of heat exchanger 12. Accordingly, the base plate 354 may be provided with communication slots having a first end in fluid communication with one of the first and second oil ports 358, 360, and a second end aligned with and in fluid communication with one of the conduit openings 54, 56 of the top plate 50. In the present embodiment, a first communication slot 372 is formed along the bottom surface 370 of the base plate 354 to provide fluid communication between the first oil port 358 and the conduit opening 54 in the top plate 50, and a second communication slot 374 is formed along the bottom surface 370 of the base plate 354 to provide fluid communication between the second oil port 360 and the conduit opening 56 in the top plate 50. The first and second oil ports 358, 360 therefore permit input and output of oil to and from heat exchanger 12, and provide fluid communication between the internal space 356 of housing 352 and the first and second manifolds 42, 44 and the plurality of first fluid flow passages 24.

Each of the third, fourth, fifth and sixth oil ports 362, 364, 366, 368 is open to the interior space 356 of housing 352 at a first terminal end, and has an opposite, outer terminal end which is adapted for connection to an external fluid conduit. In the present embodiment, the outer terminal ends of the third, fourth, fifth and sixth oil ports 362, 364, 366, 368 are internally threaded, for engagement with externally threaded fluid connection fittings, such as quick-connect fittings 376. The third and fourth oil ports 362, 364 project sideways from the interior space 356, and the fifth and sixth oil ports 366, 368 project upwardly from the exterior space 356. However, it will be appreciated that the spatial arrangement and direction of oil ports 362, 364, 366, 368 is specific to each particular application, and is variable.

Figure 14:
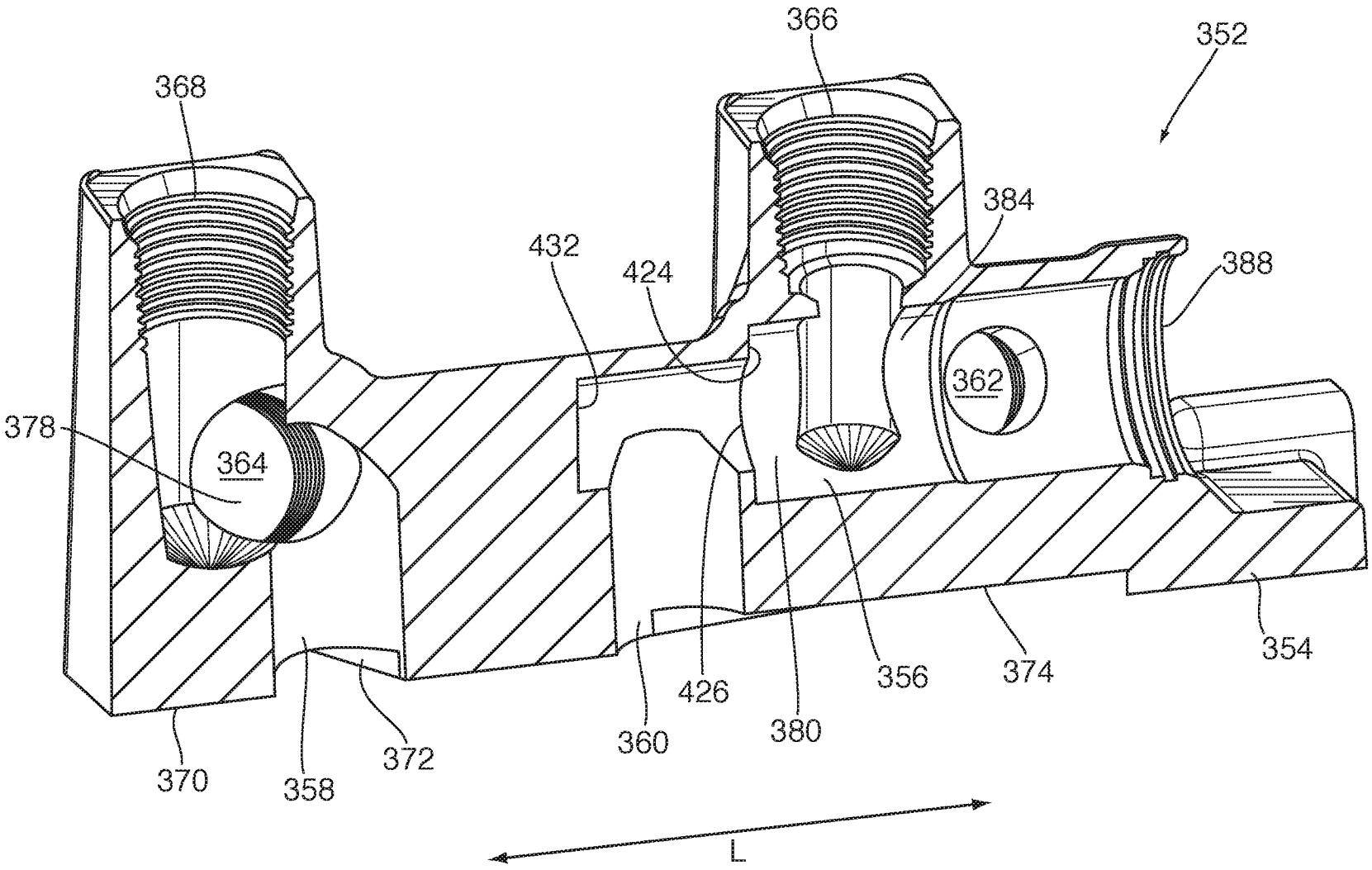
FIG. 14 is a longitudinal cross-section through the housing along line 14-14' of FIG. 11.

It can be seen from the cross-section of FIG. 14 that the inner terminal ends of the fourth and sixth oil ports 364, 368 are in close proximity to one another and to the first oil port 358, and are all in fluid communication with a first portion 378 of the interior space 356, such that the first, fourth and sixth oil ports 358, 364, 368 are all in fluid communication with each other and with the first manifold 42 of the heat exchanger 12.

It can also be seen from FIG. 14 that the inner terminal ends of the third and fifth oil ports 362, 366 are in close proximity to one another and to the second oil port 360, and are all in fluid communication with a second portion 380 of the interior space 356, such that the second, third and fifth oil ports 360, 362, 366 are all in fluid communication with each other and with the second manifold 44 of the heat exchanger 12. It can also be seen from FIG. 14 that the second, third and fifth oil ports 360, 362, 366 are spaced apart from one another along a longitudinal axis L, with the fifth oil port 366 being located between the second and third oil ports 360, 362.

The first and second portions 378, 380 of the interior space 356 are spaced apart along the longitudinal axis and are fluidly isolated from one another, except through heat exchanger 12.

The second portion 380 of the interior space 356 defines a valve chamber 384 to house a thermal valve mechanism 386 for controlling flow of oil between the first to sixth oil ports 358, 360, 362, 364, 366, 368 of the housing 352. The housing 352 also includes a valve insertion opening 388 at one end of the interior space 356, permitting the insertion of the thermal valve mechanism 386 into the valve chamber 384.

The thermal valve mechanism 386 includes a thermal or temperature responsive actuator 390 (i.e. a wax motor or an electronic valve mechanism such as a solenoid valve or any other suitable valve mechanism), as described above in connection with the other example embodiments. A valve cap 392 seals the valve mechanism 386 and sealingly closes the valve insertion opening 388. In the illustrated embodiment, the actuator 390 is a thermal actuator including an actuator piston 394 moveable between a first position and a second position by means of expansion/contraction of a wax (or other suitable material) contained in the actuator 390 which expands/contracts in response to the temperature of the first fluid entering the valve chamber 384. The actuator piston 394 may instead be controlled by activation of a solenoid coil or any other suitable valve activation means.

The valve cap 392 is retained within valve insertion opening 388 by a resilient spring clip 396 which is received inside an annular groove located at the valve insertion opening 388, and abuts against an outer face of the valve cap 392. The cap 392 is sealed within opening 388 by a resilient element such as an O-ring 398 received between an outer surface of the valve cap 392 and an inner surface of the interior space 356, with the O-ring 398 being received in a groove in the outer surface of valve cap 392.

The valve cap 392 includes a depression 400 on its inner face in which the end of the piston 394 is received, and the valve mechanism 386 further includes a spool member 402 integrated with the valve cap 392, the spool member 402 comprising an annular end portion 404 having an outer surface 406 sealingly engaged with an inner surface of the interior space 356, and an inner surface 408 defining a circular end opening comprising a first valve opening 410. The annular end portion 404 also has a flat, planar, annular end face defining a first valve seat 412.

The spool member 402 further comprises a plurality of spaced-apart longitudinal ribs 414 joining the valve cap 392 to the annular end portion 404, wherein flow openings 416 are defined between the ribs 414. It can be seen from FIGS. 12 and 13 that the annular end portion 404, the first valve seat 412 and the first valve opening 410 are located within the second portion 380 of interior space 356, between the third oil port 362 and the fifth oil port 366, which are longitudinally spaced apart from one another.

A first valve member 418 in the form of an annular disc is carried on a first end of the valve actuator 390, and a second valve member 420 in the form of an annular disc is slidably received on an outer cylindrical surface of the valve actuator 390. The second valve member 420 is biased toward the second end of the valve actuator 390 by a first end of a first spring member 422 in the form of a coil spring which is provided around the outer cylindrical surface of the valve actuator 390, and also has a second end which abuts against an annular shoulder of the valve actuator 390.

A second valve seat 424 is provided by an annular shoulder formed in the second portion 380 of interior space 356, the shoulder being formed by a reduction in diameter in the second portion 380 of interior space 356. The second valve seat 424 is flat and planar and adapted for sealed engagement with the second valve member 420, and the second valve seat 424 defines a second valve opening 426. It can be seen from FIG. 14 that the second valve seat 424 and the second valve opening 426 are located within the second portion 380 of interior space 356, between the second oil port 360 and the fifth oil port 366, which are longitudinally spaced apart from one another. The first spring member 422 acts as a return spring which opposes longitudinal motion of the second valve member 420 away from the second valve seat 424, and which also opposes longitudinal motion of the first valve member 418 away from the first valve seat 412.

A second spring member 428 in the form of a coil spring extends longitudinally from the second end of the valve actuator 390 and through the reduced-diameter portion of interior space 356 which provides fluid communication between the second valve opening 426 and the second oil port 360. The second spring member 428 acts as a return spring which opposes longitudinal motion of the second valve member 420 toward the second valve seat 424 (acting as a counter-spring relative to first spring member 422), and which opposes longitudinal motion of the first valve member 418 toward the first valve seat 412.

The first end of second spring member 428 is secured within an annular groove 430 at the second end of the valve actuator 390, and the opposed second end of second spring member 428 is received in a depression 432 in an end of the second portion 380 of interior space 356 which is opposite to the valve insertion opening 388.

FIG. 12 shows the valve mechanism 386 with the piston 394 of actuator 390 in the retracted state. This defines the "cold" state of valve mechanism 386, wherein the wax material inside actuator 390 is in a contracted state. In this cold state of valve mechanism 386, the first valve member 418 is in sealed engagement with the first valve seat 412 of spool member 402, thereby preventing fluid communication between the third oil port 362 and the fifth oil port 366 through first valve opening 410. Also, the second valve member 420 is longitudinally spaced apart from the second valve seat 424, to permit fluid communication between the second oil port 362 and the fifth oil port 366 through the second valve opening 426.

FIG. 13 shows the valve mechanism 386 with the piston 394 of actuator 390 in the extended state. This defines the "hot" state of valve mechanism 386, wherein the wax material inside actuator 390 is in an expanded state. In this hot state of valve mechanism 386, the first valve member 418 is longitudinally spaced apart from the first valve seat 412 of spool member 402, thereby permitting fluid communication between the third oil port 362 and the fifth oil port 366 through first valve opening 410. Also, the second valve member 420 is in sealed engagement with the second valve seat 424, to prevent fluid communication between the second oil port 362 and the fifth oil port 366 through the second valve opening 426. Also, in this hot state, the actuator 390 acts against the bias of the first and second spring members 422, 428.

Figure 17:
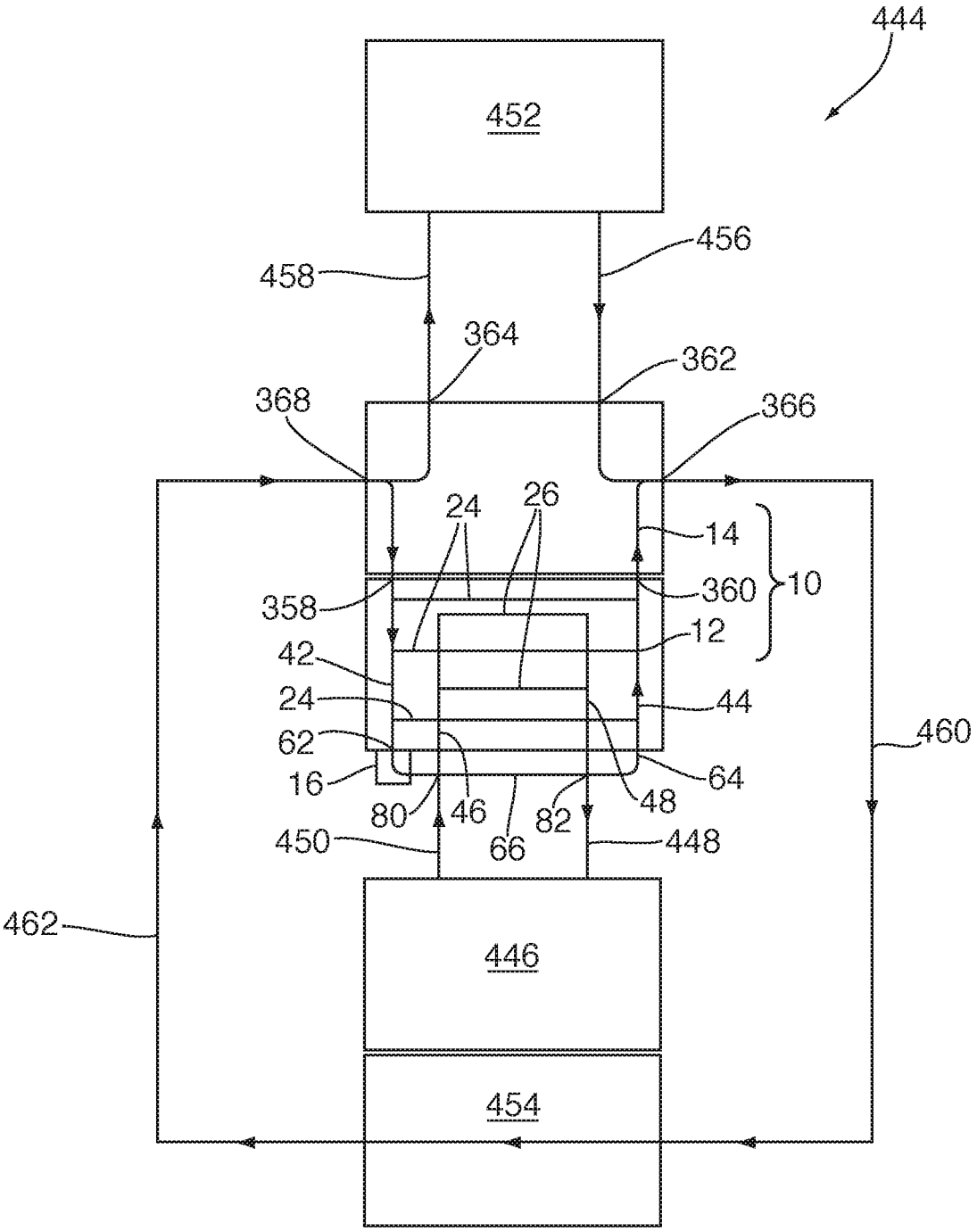
FIG. 17 is a schematic view of a transmission oil circulation system in a cold state.
Figure 18:
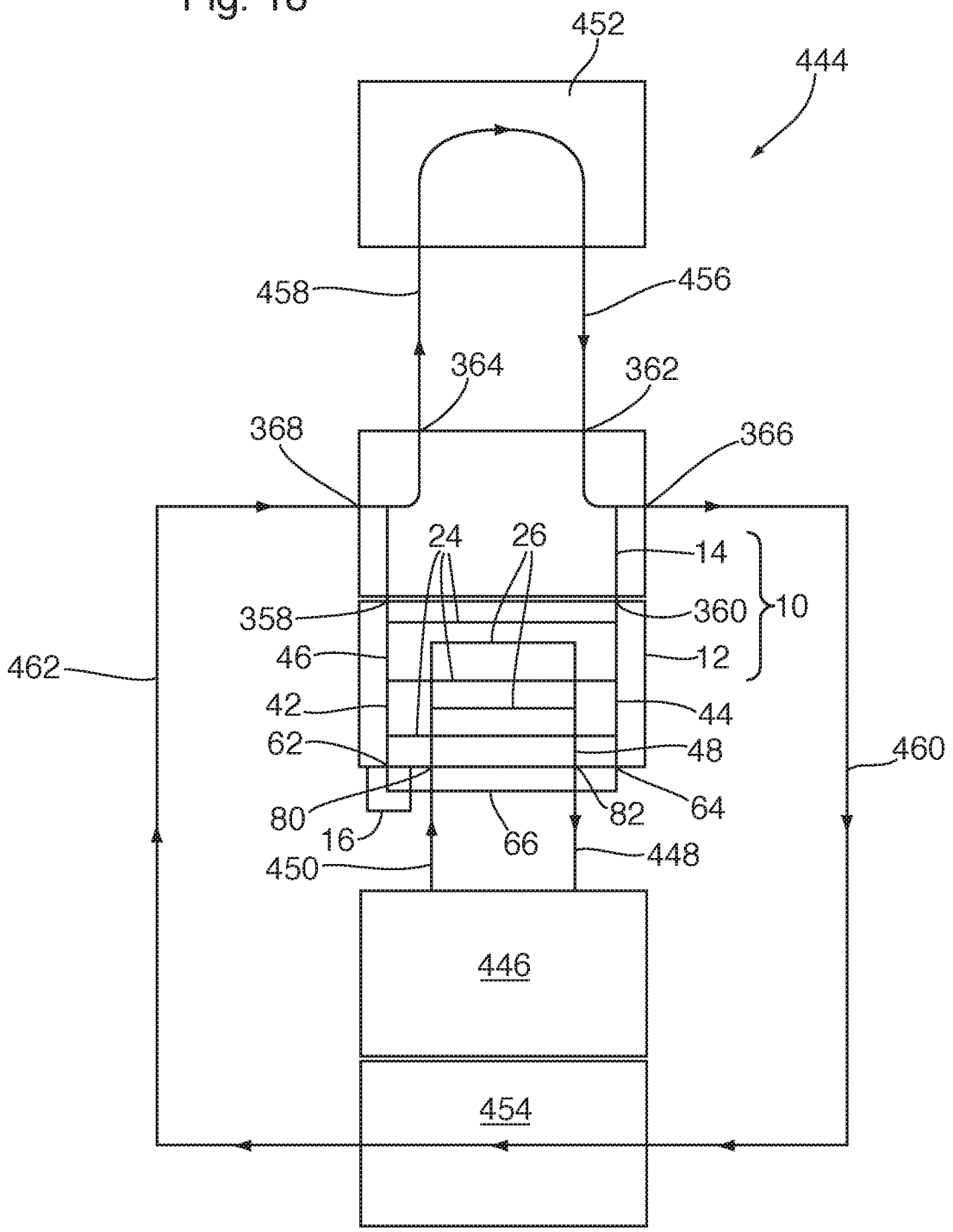
FIG. 18 is a schematic view of the transmission oil circulation system in a hot state.

FIGS. 17 and 18 schematically show how the heat exchanger assembly 10 may be incorporated into a transmission oil circulation system 444 for controlling the temperature of the transmission oil in a motor vehicle having an internal combustion engine 446 and a transmission 454, wherein an engine coolant is used to alternately heat and cool the transmission oil circulating within system 444. In addition to heat exchanger assembly 10, the transmission oil circulation system 444 also includes a transmission oil cooler (TOC) 452, transmission 454, conduits 456, 458 connecting the heat exchanger assembly 10 to the TOC 452, and conduits 460, 462 connecting the heat exchanger assembly 10 to the transmission 454.

The vehicle also includes a coolant circulation system including the heat exchanger assembly 10, the engine 446, and coolant conduits 448, 450 connecting the coolant inlet and outlet ports of the engine 446 to the coolant fittings 80, 82 of the heat exchanger 12, for circulating the coolant (second fluid) through the third and fourth manifolds 46, 48 and the second fluid flow passages 26 thereof.

In the configuration of system 444 illustrated in FIGS. 17 and 18, the oil conduit 456 extends between the third oil port 362 and an outlet of the TOC 452, and therefore third oil port 362 is an oil inlet port through which oil is received from the TOC 452. The oil conduit 458 extends between the fourth oil port 364 and an inlet of the TOC 452, and therefore the fourth oil port 364 is an oil outlet port through which oil is discharged to the TOC 452. The oil conduit 460 extends between the fifth oil port 366 and an inlet port of the transmission 454, and therefore the fifth oil port 366 is an oil outlet port 366 through which oil is discharged to the transmission 454. The oil conduit 462 extends between the sixth oil port 368 and the transmission 454, and therefore the sixth oil port 368 is an oil inlet port through which oil is received from the transmission 454. As also shown in FIGS. 17 and 18 the first and second oil ports 358, 360 are internal ports connecting the heat exchanger 12 to the valve integration unit 14, with the first oil port 358 comprising an oil outlet port through which oil is discharged to heat exchanger 12, and the second oil port 360 comprising an oil inlet port through which oil is received from the heat exchanger 12.

In the cold state shown in FIG. 17, with the valve mechanism 386 in the configuration shown in FIG. 12, the transmission oil circulating through system 444 is cold, and the piston 394 of valve actuator 390 is retracted. Such conditions exist, for example, upon initial start-up of the vehicle. Under these conditions, the first valve member 418 is seated against first valve seat 412 and the second valve member 420 is spaced from the second valve seat 424. Thus, oil flow from the second oil port 360 to the fifth oil port 366 through second valve opening 426 is permitted, while oil flow from the third oil port 362 to the fifth oil port 366 through first valve opening 410 is blocked. Under these conditions, cold transmission oil from transmission 454 will flow through oil conduit 462 and enter the first portion 378 of the interior space 356 through the sixth oil port 368. Due to the configuration of valve mechanism 386, the oil entering interior space 356 through sixth oil port 368 will preferentially enter the heat exchanger 12 through the first oil port 358, and will then flow through the first manifold 42, the first fluid flow passages 24, and the second manifold 44, before re-entering the housing 352 through the second oil port 360. The oil then flows through the second valve opening 426 and exits the assembly 10 through the fifth oil port 366, to enter the oil conduit 460 and be returned to the transmission 454.

In the meantime, coolant is heated by engine 446 and is circulated through the second fluid flow passages 26 of heat exchanger 12, where it transfers heat to the transmission oil being circulated through the first fluid flow passages 24. Thus, the transmission oil is heated in assembly 10 before it is returned to the transmission 454. Also, because the first valve member 418 blocks flow through the first valve opening 410, there will be little or no oil flow from the sixth oil port 368 to the TOC 452 through the fourth oil port 364 with the assembly in the cold state of FIG. 17.

It can be seen that the oil circulating through assembly 10 will flow over and around the valve actuator 390 as it passes through the valve chamber 384 from the second oil port 360 to the fifth oil port 366. Thus, the valve actuator 390 performs a temperature sensing function, and as the temperature of the oil increases, the wax inside actuator 390 will expand and cause the piston 394 to extend. The extension of piston 394 will cause longitudinal movement of the actuator body 390 such that the first valve member 418 will be moved out of engagement with first valve seat 412 to open the first valve opening 410, and the second valve member 420 will be moved into sealed engagement with the second valve seat 424 to close the second valve opening 426.

This movement of valve members 418, 420 will cause the valve mechanism 386 to adopt the configuration shown in FIG. 18, also referred to as the hot state. In this state, the transmission oil circulating through system 444 is above a threshold temperature and requires cooling. Thus, oil flow from the second oil port 360 to the fifth oil port 366 through second valve opening 426 is blocked, while oil flow from the third oil port 362 to the fifth oil port 366 through first valve opening 410 is permitted. Under these conditions, hot transmission oil from transmission 454 will flow through oil conduit 462 and enter the first portion 378 of the interior space 356 through the sixth oil port 368. However, rather than entering heat exchanger 12 through first oil port 358, the oil is diverted to the TOC 452 through oil conduit 458. After being cooled as it passes through TOC 452, the oil is returned to assembly 10 through oil conduit 456, and enters valve chamber 384 through the third oil port 362. The oil then flows over and around the actuator 390 as it passes to the fifth oil port 366 to be discharged from assembly 300, and then flows to the transmission 454 through the oil conduit 460. Therefore, in the hot state, oil from the transmission 454 bypasses the heat exchanger 12 and is cooled in the TOC 452.

Figure 15:
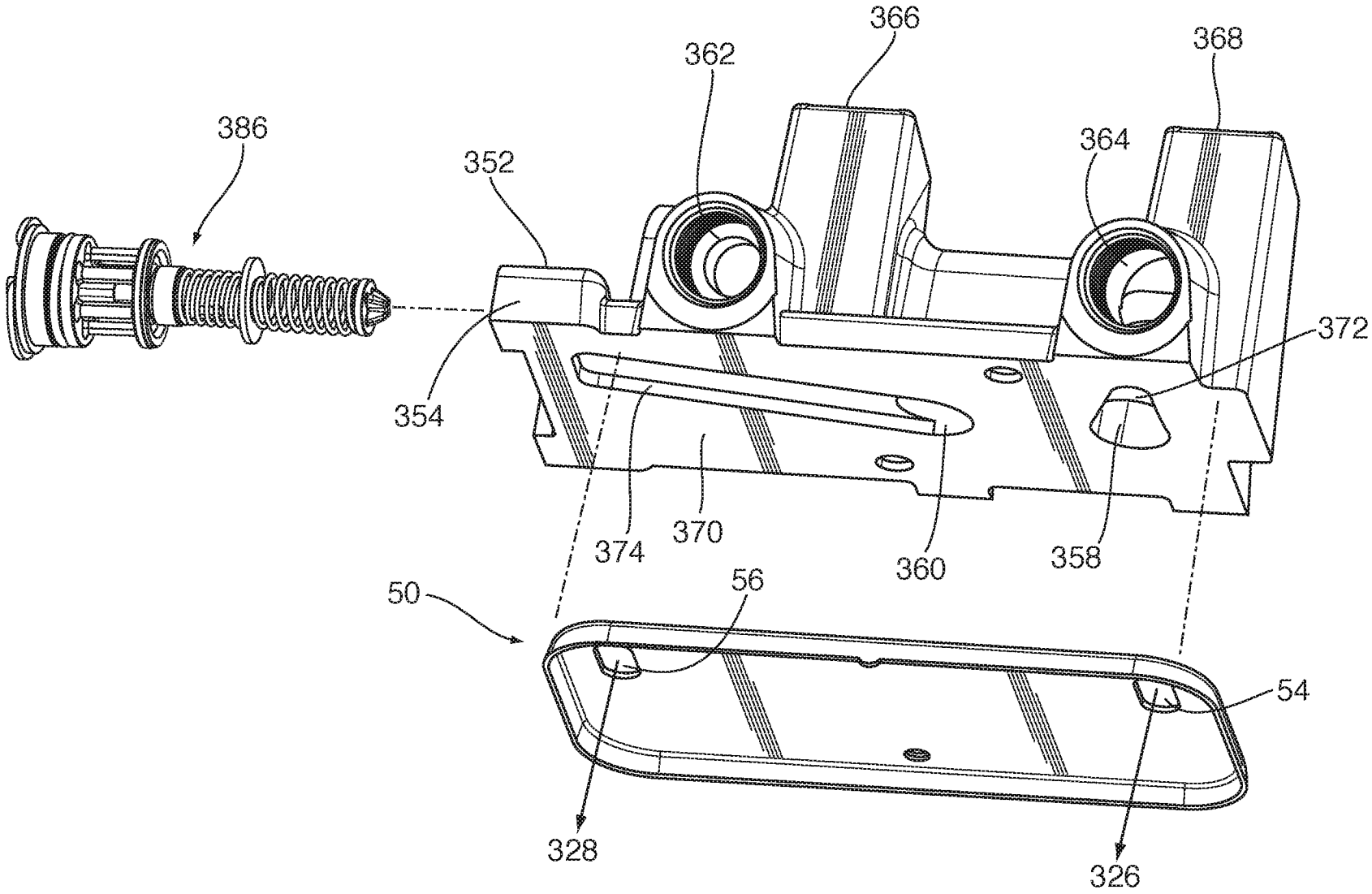
FIG. 15 is a perspective bottom view of the housing, together with the thermal valve mechanism and the top plate of the heat exchanger.
Figure 16:
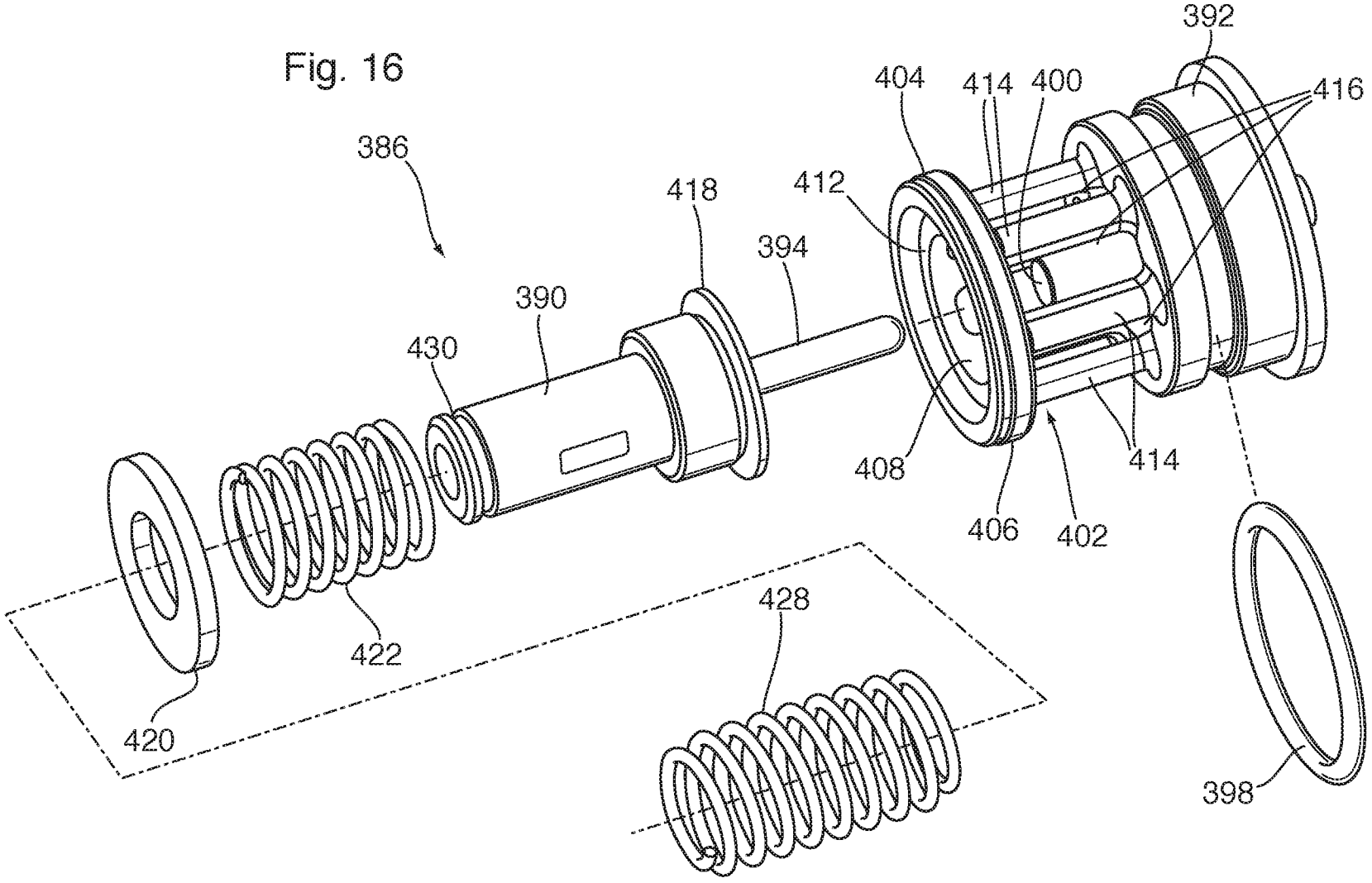
FIG. 16 is an exploded view of the thermal valve mechanism.

As can be seen from FIGS. 15 and 16, the bypass valve member 122 of the pressure bypass valve assembly 16 is positioned to block the bypass hole 62 of bottom plate 52 in both the hot and cold states, independent of the configuration of the actuator 390 and piston 394, and independent of the positions of the first and second valve members 418, 420. Therefore, the bypass valve member 122 is not temperature actuated. Rather, it can be seen from the drawings that the coil spring 134 biases the bypass valve member 122 toward the closed position, i.e. with the second end face 136 of bypass valve member 122 sealed against the valve seat 102. With the bypass hole 62 blocked by bypass valve member 122, fluid flow through bypass flow passage 66 is prevented.

Under some conditions, the oil pressure in circulation system 444 may increase beyond a normal level. For example, cold transmission oil is relatively viscous and this will increase the pressure drop between the inlet and the outlet of heat exchanger 12, corresponding to the respective first and second conduit openings 54, 56. Where the pressure differential is sufficiently high, the pressure of the oil will overcome the biasing force of the coil spring 134, thereby compressing the coil spring 134 and forcing the bypass valve member 122 out of engagement with the valve seat 102, opening the bypass hole 62, and permitting oil to flow through the bypass flow passage 66, thereby permitting the oil to bypass the heat exchanger 12. Once the pressure differential decreases, the coil spring 134 will force the bypass valve member 122 into sealed engagement with the valve seat 102, to once again block oil flow through the bypass flow passage 66.

In the present embodiment, the metal components of heat exchanger assembly 10 (i.e. excluding the pressure bypass valve assembly 16 and thermal valve mechanism 386) may be comprised of aluminum (including alloys thereof) and are joined together by brazing. For example, these metal components may be assembled and then heated to a brazing temperature in a brazing oven, whereby the metal components are brazed together in a single brazing operation, as is known in the art, to form a brazed sub-assembly. Following the brazing operation, the pressure bypass valve assembly 16 and thermal valve mechanism 386 are then assembled to the brazed sub-assembly.

While the present invention has been illustrated and described with reference to specific exemplary embodiments of heat exchanger assemblies comprising a heat exchanger, a thermal valve integration unit and a pressure bypass valve assembly, it is to be understood that the present invention is not limited to the details shown herein since it will be understood that various omissions, modifications, substitutions and changes in the forms and details of the disclosed system and their operation may be made by those skilled in the art without departing in any way from the spirit and scope of the present invention. For instance, while heat exchanger assembly 10 has been described in connection with particular applications for cooling/heating transmission oil, it will be understood that any of the heat exchanger assemblies described herein can be used for various other heat exchange applications and should not be limited to applications associated with the transmission of an automobile system.

What is claimed is:

1. A heat exchanger assembly comprising:

(a) a heat exchanger comprising:

a plurality of alternating first and second fluid flow passages in heat exchange relation;

a first manifold and a second manifold interconnected by the plurality of first fluid flow passages;

a third manifold and a fourth manifold interconnected by the plurality of second fluid flow passages;

(b) a thermal valve integration unit fixedly attached to the heat exchanger, wherein the valve integration unit comprises a housing and a thermal valve mechanism;

wherein the housing comprises first to sixth fluid ports, three of said fluid ports being provided for input of a first fluid into the thermal valve integration unit, and three of said fluid ports being provided for output of the first fluid from the thermal valve integration unit;

wherein the housing further comprises an interior space comprising a first portion and a second portion, the interior space defining a longitudinal axis of the housing, and wherein the second portion of the interior space defines a valve chamber; and wherein the first and second fluid ports provide fluid communication between the interior space of the housing and the first and second manifolds of the heat exchanger, wherein one of the first and second fluid ports is provided for input of the first fluid from the heat exchanger to the thermal valve integration unit, and the other of the first and second fluid ports is provided for output of the first fluid from the thermal valve integration unit to the heat exchanger;

(c) a pressure bypass comprising a first bypass hole and a second bypass hole formed in the heat exchanger, and a bypass flow passage, wherein bypass flow passage is in fluid communication with the first manifold through the first bypass hole and in fluid communication with the second manifold through the second bypass hole; and (d) a pressure bypass valve assembly adapted to block flow of the first fluid through the bypass flow passage where fluid pressure inside the heat exchanger is less than a threshold pressure, and to permit flow of the first fluid through the bypass flow passage where the fluid pressure is greater than the threshold pressure;

wherein the third and fourth fluid ports of the thermal valve integration unit provide fluid communication between the interior space of the housing and a first remote vehicle component, wherein one of the third and fourth fluid ports is provided for input of the first fluid from the first remote vehicle component to the thermal valve integration unit, and the other of the third and fourth fluid ports is provided for output of the first fluid from the thermal valve integration unit to the first remote vehicle component;

wherein the fifth and sixth fluid ports provide fluid communication between the interior space of the housing and a second remote vehicle component, wherein one of the fifth and sixth fluid ports is provided for input of the first fluid from the second remote vehicle component to the thermal valve integration unit, and the other of the fifth and sixth fluid ports is provided for output of the first fluid from the thermal valve integration unit to the second remote vehicle component;

wherein the first, fourth and sixth fluid ports of the housing are in fluid communication with each other through the first portion of the interior space;

wherein the second, third and fifth fluid ports of the housing are in fluid communication with each other through the second portion of the interior space; and wherein the thermal valve mechanism is oriented along the longitudinal axis and comprises:

a temperature responsive actuator;

a first valve element being movable along the longitudinal axis for opening and closing a first valve opening located in the second portion of the interior space, the first valve element and the first valve opening being located between the third fluid port and the fifth fluid port which are longitudinally spaced apart from one another, wherein the movement of the first valve element is actuated by the temperature responsive actuator; and a second valve element being movable along the longitudinal axis for opening and closing a second valve opening located in the second portion of the interior space, the second valve element and the second valve opening being located between the second fluid port and the fifth fluid port which are longitudinally spaced apart from one another, wherein the movement of the second valve element is actuated by the temperature responsive actuator.

2. The heat exchanger assembly of claim 1, wherein the heat exchanger comprises first and second end plates at opposite ends of a heat exchanger core comprising a stack of core plates;

wherein the thermal valve integration unit is fixedly attached to an outer surface of the first end plate;

wherein the first and second bypass holes are provided in the second end plate; and wherein the bypass flow passage is provided on the outer surface of the second end plate.

3. The heat exchanger assembly of claim 2, wherein the bypass flow passage comprises an elongate channel provided on the outer surface of the second end plate.

4. The heat exchanger assembly of claim 3, wherein the elongate channel is surrounded by a planar sealing flange which encloses the first and second bypass holes, such that the bypass flow passage comprises a sealed flow passage adapted to carry the first heat transfer fluid between the first and second bypass holes outside the core of the heat exchanger.

5. The heat exchanger assembly of claim 1, wherein the pressure bypass valve assembly comprises:

a housing having a first end in sealed fluid communication with a hole in the bypass flow passage which is aligned with the first bypass hole;

an annular valve seat located inside the bypass flow passage and surrounding the first bypass hole; and a valve member adapted to form a fluid-tight seal against the valve seat and being slidable in the housing of the pressure bypass valve assembly, toward and away from the valve seat.

6. The heat exchanger assembly of claim 5, wherein the pressure bypass valve assembly further comprises a spring member which biases the valve member toward the valve seat; and wherein the spring member is compressible by the application of a fluid force greater than the threshold pressure to the valve member.

7. The heat exchanger assembly of claim 1, wherein the fifth fluid port is located along the longitudinal axis between the second and third fluid ports.

8. The heat exchanger assembly of claim 1, wherein the first and second valve members are connected to the temperature responsive actuator.

9. The heat exchanger assembly of claim 1, wherein the temperature responsive actuator comprises a generally cylindrical actuator body having a first end and a second end, wherein the first valve member is provided at the first end of the actuator and the second valve member is provided at the second end of the actuator.

10. The heat exchanger assembly of claim 9, wherein the first valve member comprises an annular disc carried on the first end of the temperature responsive actuator.

11. The heat exchanger assembly of claim 9, wherein the second valve member is slidably received on an outer cylindrical surface of the valve actuator, and is biased toward the second end of the actuator by a first spring member comprising a coil spring which is provided around the outer cylindrical surface of the actuator.

12. The heat exchanger assembly of claim 1, wherein the housing has a unitary, one-piece construction, and includes a base plate directly connected to the heat exchanger;

wherein the base plate has a bottom surface which is sealingly joined to a first end plate of the heat exchanger; and wherein the first and second fluid ports extend through the base plate from the bottom surface to the interior space, to provide fluid communication between the interior space and the first and second manifolds of the heat exchanger.

13. The heat exchanger assembly of claim 1, wherein the first and second portions of the interior space of the housing are spaced apart along the longitudinal axis.

14. A fluid circulation system in a motor vehicle, comprising:

the heat exchanger assembly of claim 1, wherein the heat exchanger is a transmission oil heater heat exchanger having coolant inlet and outlet ports, the first fluid is transmission oil and the second fluid is engine coolant;

an internal combustion engine having coolant inlet and outlet ports;

a transmission;

a transmission oil cooler;

a pair of transmission oil conduits connecting the third and fourth fluid ports of the valve integration unit to the transmission oil cooler;

a pair of transmission oil conduits connecting the fifth and sixth fluid ports of the valve integration unit to the transmission;

a pair of coolant conduits connecting the coolant inlet and outlet ports of the internal combustion engine to the coolant inlet and outlet ports of the transmission oil heat exchanger.

15. The fluid circulation system of claim 14, wherein the transmission oil heat exchanger is a transmission oil heater or a second transmission oil cooler.

* * * * *